US010392180B1

(12) United States Patent
Smith et al.

(10) Patent No.: US 10,392,180 B1
(45) Date of Patent: Aug. 27, 2019

(54) PORTABLE STORAGE CONTAINER

(71) Applicant: Otter Products, LLC, Fort Collins, CO (US)

(72) Inventors: W. Travis Smith, Fort Collins, CO (US); Richard W. Vinson, Fort Collins, CO (US); Zachary D. Dunkin, Wellington, CO (US); Todd Eichinger, Fort Collins, CO (US); Ryan J. Cavenagh, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 0 days.

(21) Appl. No.: 16/419,896

(22) Filed: May 22, 2019

Related U.S. Application Data

(63) Continuation of application No. 15/935,228, filed on Mar. 26, 2018.

(Continued)

(51) Int. Cl.
*B65D 45/00* (2006.01)
*A45F 3/04* (2006.01)

(Continued)

(52) U.S. Cl.
CPC ..... *B65D 81/3816* (2013.01); *A45C 11/20* (2013.01); *A45F 3/02* (2013.01);

(Continued)

(58) Field of Classification Search
CPC ..... A45C 11/20; A45C 7/0022; A45C 13/007; A45C 13/02; B65D 81/3888;

(Continued)

(56) References Cited

U.S. PATENT DOCUMENTS 1,468,563 A 9/1923 Girard
1,934,360 A * 11/1933 Laufman ..... A45C 3/00 190/109

(Continued)

FOREIGN PATENT DOCUMENTS

EP 3061704 A1 8/2016
WO 2004029526 A1 4/2004

(Continued)

OTHER PUBLICATIONS amazon.com, "Farberware 5190590 3-piece cutting board set," dated Jul. 23, 2011, downloaded from https ://www.amazon.com/Farberware-5190590-3-Piece-Plastic-Assorted/dp/80731KDNM P/ref=cm_cr_arp _d_product_top? ie=UTF8 Mar. 11, 2019, 8 pages.

(Continued)

*Primary Examiner* — Brian D Nash

(57) ABSTRACT

A portable insulated storage container comprises an outer layer and an inner liner positioned inside the outer layer. The inner liner defining an internal storage volume inside the portable insulated storage container. Insulation is positioned between the inner liner and the outer layer. A closable opening extends through the outer layer and the inner liner for accessing the internal storage volume from outside the portable insulated storage container. A closure mechanism has a first rigid member hingedly attached to a second rigid member for permitting access to the internal storage volume through the closable opening and for closing the closable opening. The closure mechanism extends around a perimeter of the closable opening. The rigid members each extend around respective portions of the perimeter of the closable opening, pivot in opposite directions, and are in substantially a same plane when the closure mechanism is in the opened position.

20 Claims, 17 Drawing Sheets

Related U.S. Application Data

(60) Provisional application No. 62/611,418, filed on Dec. 28, 2017, provisional application No. 62/545,571, filed on Aug. 15, 2017, provisional application No. 62/483,999, filed on Apr. 11, 2017.

(51) Int. Cl.
*A45F 3/00* (2006.01)
*B65D 81/38* (2006.01)
*A45C 11/20* (2006.01)
*A45F 3/02* (2006.01)

(52) U.S. Cl.
CPC ..... *A45F 3/04* (2013.01); *B65D 45/00* (2013.01); *A45F 2003/002* (2013.01)

(58) Field of Classification Search
CPC .. B65D 81/389; B65D 21/0204; B65D 81/38; B65D 81/3853
See application file for complete search history.

(56) References Cited

U.S. PATENT DOCUMENTS 2,627,993 A 2/1953 Hafner
3,395,550 A 8/1968 Dungan
3,850,398 A 11/1974 Kantor
3,868,829 A 3/1975 Mann et al.
3,939,986 A 2/1976 Pierro
4,024,731 A 5/1977 Branscum
4,091,852 A * 5/1978 Jordan ..... A45C 7/004 206/522
4,213,310 A 7/1980 Buss
D275,822 S 10/1984 Gatland et al.
4,515,421 A 5/1985 Steffes
4,560,128 A 12/1985 Willeby et al.
4,706,856 A * 11/1987 Jacober ..... A45F 3/04 224/153
RE32,740 E 8/1988 Steffes
4,964,528 A 10/1990 Wagoner
4,988,216 A 1/1991 Lyman
5,052,185 A 10/1991 Spahr
D325,323 S 4/1992 Kahl
D328,389 S 8/1992 Pardo
D330,488 S 10/1992 Daniels
5,181,612 A 1/1993 Liu
5,285,656 A 2/1994 Peters
D353,082 S 12/1994 Keven
D354,419 S 1/1995 Kahl et al.
5,403,095 A 4/1995 Melk
5,501,338 A * 3/1996 Preston ..... A45C 11/20 206/499
5,509,279 A 4/1996 Brown et al.
D387,249 S 12/1997 Mogil
5,758,513 A * 6/1998 Smith ..... A45C 11/20 62/457.5
5,816,432 A 10/1998 Hammen et al.
5,845,515 A 12/1998 Nelson
D419,297 S 1/2000 Richardson et al.
D419,767 S 2/2000 Richardson et al.
D419,768 S 2/2000 Richardson et al.
6,039,202 A 3/2000 Olstad et al.
D425,761 S 5/2000 Philipson et al.
6,065,873 A 5/2000 Fowler
6,067,813 A * 5/2000 Smith ..... A45C 11/20 62/371
6,116,045 A * 9/2000 Hodosh ..... A45C 11/20 62/457.4
D435,196 S 12/2000 Gregor et al.
6,179,025 B1 * 1/2001 Sutton ..... A45C 3/08 150/105
6,185,860 B1 2/2001 Thibodeaux
6,193,097 B1 2/2001 Perianes
6,237,776 B1 * 5/2001 Mogil ..... A45C 3/00 150/106
6,244,458 B1 6/2001 Frysinger et al.
6,247,328 B1 * 6/2001 Mogil ..... A45C 7/0077 383/110
D444,683 S 7/2001 Corrion
6,276,579 B1 8/2001 DeLoach
D451,765 S 12/2001 Israel et al.
6,328,179 B1 12/2001 Conrado et al.
D455,934 S 4/2002 Culp et al.
6,409,066 B1 6/2002 Schneider et al.
D465,134 S 11/2002 Joss
6,505,479 B2 1/2003 Defelice et al.
D472,384 S 4/2003 Richardson
6,595,687 B2 7/2003 Godshaw et al.
6,751,963 B2 6/2004 Navedo et al.
D502,599 S 3/2005 Cabana et al.
6,895,778 B1 5/2005 Ackerman
D513,123 S 12/2005 Richardson et al.
D514,808 S 2/2006 Morine et al.
D516,807 S 3/2006 Richardson et al.
D527,226 S 8/2006 Maldonado
D527,953 S 9/2006 Gal
7,140,507 B2 11/2006 Maldonado et al.
7,240,513 B1 * 7/2007 Conforti ..... A45C 13/02 62/457.2
7,296,433 B2 11/2007 Uihlein et al.
7,313,927 B2 * 1/2008 Barker ..... F25D 3/08 62/457.2
7,682,080 B2 3/2010 Mogil
7,730,739 B2 * 6/2010 Fuchs ..... A45C 11/20 62/457.7
D635,832 S 4/2011 Bergin
D637,044 S 5/2011 Davis
8,043,004 B2 10/2011 Mogil
8,065,889 B1 11/2011 Silberman
8,246,190 B2 8/2012 Boiteau et al.
8,640,937 B2 * 2/2014 Pruchnicki ..... A45C 11/20 224/612
D712,720 S 9/2014 Seiders
D712,721 S 9/2014 Seiders
D712,722 S 9/2014 Seiders
D712,723 S 9/2014 Seiders
D714,125 S 9/2014 Seiders
8,863,546 B2 10/2014 Oberweis
8,910,819 B2 12/2014 Seiders
D722,474 S 2/2015 Seiders
D722,475 S 2/2015 Seiders
D732,348 S 6/2015 Seiders et al.
D732,349 S 6/2015 Seiders et al.
D732,350 S 6/2015 Seiders et al.
D732,899 S 6/2015 Seiders et al.
9,139,352 B2 9/2015 Seiders et al.
9,187,232 B2 11/2015 Seiders
D752,347 S 3/2016 Seiders et al.
9,316,428 B2 4/2016 Mech
9,389,010 B1 7/2016 Booker
9,408,445 B2 8/2016 Mogil et al.
9,446,847 B2 9/2016 Richardson et al.
9,500,400 B2 11/2016 Smith
9,834,342 B2 4/2017 Seiders
D786,559 S 5/2017 Seiders et al.
D786,560 S 5/2017 Seiders et al.
D786,561 S 5/2017 Seiders et al.
D786,562 S 5/2017 Seiders et al.
D787,187 S 5/2017 Seiders et al.
D797,454 S 9/2017 Seiders et al.
D797,455 S 9/2017 Seiders et al.
D798,670 S 10/2017 Seiders et al.
D799,276 S 10/2017 Seiders et al.
D799,277 S 10/2017 Seiders et al.
D799,905 S 10/2017 Seiders et al.
D801,123 S 10/2017 Seiders et al.
9,796,517 B2 10/2017 Seiders et al.
D802,373 S 11/2017 Seiders et al.
D804,905 S 12/2017 Seiders et al.
D805,851 S 12/2017 Seiders et al.
D820,646 S 6/2018 Yockey
D821,165 S 6/2018 Guerdrum et al.
D821,825 S 7/2018 Sullivan et al.
D823,064 S 7/2018 Eichinger et al.

(56) References Cited

U.S. PATENT DOCUMENTS

| | | | | |
|---|---|---|---|---|
| D823,065 | S | 7/2018 | Eichinger et al. | |
| D823,066 | S | 7/2018 | Eichinger et al. | |
| 10,029,842 | B2 | 7/2018 | Seiders et al. | |
| D824,730 | S | 8/2018 | Guerdrum et al. | |
| 10,092,137 | B1 | 10/2018 | Nelson et al. | |
| 10,221,005 | B2 | 3/2019 | Lewis | |
| 2002/0126920 | A1* | 9/2002 | Mogil | A45C 7/0077 383/110 |
| 2003/0038138 | A1 | 2/2003 | Komurke | |
| 2004/0035143 | A1* | 2/2004 | Mogil | A45C 7/0077 62/457.2 |
| 2004/0178208 | A1 | 9/2004 | Leba et al. | |
| 2004/0238543 | A1 | 12/2004 | Askew | |
| 2004/0262319 | A1 | 12/2004 | Fisher | |
| 2005/0006268 | A1 | 1/2005 | Futemick | |
| 2005/0263527 | A1 | 12/2005 | Maldonado et al. | |
| 2005/0263528 | A1 | 12/2005 | Maldonado et al. | |
| 2005/0279123 | A1 | 12/2005 | Maldonado et al. | |
| 2005/0279124 | A1 | 12/2005 | Maldonado | |
| 2007/0137958 | A1 | 6/2007 | Hamlin | |
| 2007/0278234 | A1 | 12/2007 | Mogil | |
| 2008/0094853 | A1 | 4/2008 | Kim et al. | |
| 2008/0260303 | A1 | 10/2008 | Lesseux et al. | |
| 2009/0020579 | A1* | 1/2009 | Jackson | A45C 13/10 224/627 |
| 2010/0287976 | A1 | 11/2010 | Roof et al. | |
| 2011/0056233 | A1 | 3/2011 | Flaker et al. | |
| 2011/0182532 | A1 | 7/2011 | Baltus | |
| 2011/0203297 | A1 | 8/2011 | Oberweis | |
| 2011/0220531 | A1 | 9/2011 | Meether et al. | |
| 2011/0289958 | A1 | 12/2011 | White et al. | |
| 2013/0264161 | A1 | 10/2013 | Thompson | |
| 2014/0013789 | A1 | 1/2014 | Conrad et al. | |
| 2014/0248003 | A1 | 9/2014 | Mogil et al. | |
| 2015/0158539 | A1 | 6/2015 | Jensen et al. | |
| 2015/0210444 | A1 | 7/2015 | Mercado et al. | |
| 2015/0369529 | A1 | 12/2015 | Monroe | |
| 2016/0101924 | A1 | 4/2016 | Mitchell et al. | |
| 2016/0257479 | A1 | 9/2016 | Seiders et al. | |
| 2016/0279840 | A1 | 9/2016 | French et al. | |
| 2017/0023289 | A1 | 1/2017 | Anderson | |
| 2017/0073146 | A1 | 3/2017 | Kuhn et al. | |
| 2017/0073147 | A1 | 3/2017 | Kuhn | |
| 2017/0233139 | A1 | 8/2017 | Averill | |
| 2017/0305639 | A1 | 10/2017 | Kuhn et al. | |
| 2017/0350635 | A1 | 12/2017 | Thirumurugavel | |
| 2018/0149400 | A1 | 5/2018 | Valencia | |
| 2018/0186547 | A1 | 7/2018 | Morine et al. | |
| 2018/0186550 | A1 | 7/2018 | Morine et al. | |
| 2018/0263346 | A1 | 9/2018 | Stephens | |
| 2018/0290814 | A1* | 10/2018 | Smith | B65D 81/3816 |
| 2018/0346229 | A1 | 12/2018 | Guerdrum et al. | |
| 2018/0353379 | A1 | 12/2018 | Chou et al. | |
| 2019/0023480 | A1 | 1/2019 | Lin | |

FOREIGN PATENT DOCUMENTS

| | | | |
|---|---|---|---|
| WO | 2006007266 | A2 | 1/2006 |
| WO | 2006009537 | A1 | 1/2006 |
| WO | 2014105962 | A1 | 7/2014 |
| WO | 2016154105 | A1 | 9/2016 |

OTHER PUBLICATIONS

Digital Trends, "The new Venture coolers from Otterbox . . . ", Posted May 9, 2017.(https://www.digitaltrends.com/outdoors/otterbox-venture-coolers/).

Ice Chest Guide, "Top 10 Best Soft Cooler Reviews and Buying Guide for 2018", downloaded from http://www.icechestguide.com/top-10-best-soft-cooler-reviews-and-buying-guide.html Jan. 25, 2018, 12 pages.

OtterBox, "Rugged Venture Coolers", Accessed Jan. 16, 2018. (https://www.otterbox.com/en-us/venture-coolers.html).

Pelican Consumer, Coolers—Hunting, Fishing, Camping, downloaded from http://www.pelican.com/us/en/products/coolers May 8, 2017, 2 pages.

Pelican Products, "70QT Cooler", Accessed Jan. 16, 2018. (http://www.pelican.com/us/en/product/outdoor-heavy-dutycoolers/elite-cooler/cooler/70QT/).

Polar Bear Coolers, "24 Pack Eclipse Cooler," downloaded from http://www.polarbearcoolers.com/product/PB327.html Jan. 30, 2018, 6 pages.

Polar Bear Coolers, "Eclipse Backpack Cooler," downloaded from http://www.polarbearcoolers.com/product/PB397.html Jan. 29, 2018, 4 pages.

Rei Co-Op, "Soft-sided Coolers", downloaded from https://www.rei.com/c/soft-sided-coolers?r-c&origin+web&ir=category%3Asoft-sided-coolers%page=1 Jan. 25, 2018, 6 pages.

RTIC, "RTIC Soft Pack Coolers," downloaded form https://www.rticcoolers.com/shop/coolers/softpak Jan. 25, 2018, 16 pages.

RTIC, Cooler Accessories, downloaded May 8, 2017 from http://www.rticcoolers.com/shop/coolers/accessories, 14 pages.

The Cooler Box, "Cordova Coolers vs Yeti—Is This New Cooler Better Than Yeti?", Published Oct. 24, 2016.(http://thecoolerbox.com/cordova-coolers-vs-yeti/).

Yeti Coolers, "Hopper Soft Sided Portable Coolers," downloaded from https://www.yeti.com/soft-coolers Jan. 25, 2018, 6 pages.

Yeti Coolers, "Tundra Cooler Divider," dated Mar. 11, 2014, downloaded from https://www.yeti.com/en_US/accessories/tundra-dividers/DV.html?cg id =accessories# Mar. 11, 2019, 9 pages.

Yeti Coolers, Tundra Cooler Divider, downloaded from www.yeti.com/tundra-dividers May 8, 2017, 4 pages.

Yeti Coolers, Tundra Ice Chests, downloaded from http://yeti.com/tundra May 8, 2017, 7 pages.

Yeti Coolers, Yeti Accessories & Parts, downloaded from http://yeti.com/accessories May 8, 2017, 5 pages.

* cited by examiner

PORTABLE STORAGE CONTAINER

CROSS REFERENCE TO RELATED APPLICATIONS

This application claims priority to U.S. patent application Ser. No. 15/935,228, filed Mar. 26, 2018, U.S. Provisional Patent Application No. 62/611,418, filed Dec. 28, 2017, U.S. Provisional Patent Application No. 62/545,571, filed Aug. 15, 2017, and U.S. Provisional Patent Application No. 62/483,999, filed Apr. 11, 2017, all of which are hereby incorporated by reference in their entireties.

FIELD

This disclosure relates generally to a portable storage container for storing objects, such as food and/or beverages.

BACKGROUND

When participating in leisure activities, it is often desirable to bring along food or beverages for consumption before, during, and/or after the activity. Often, the food may be perishable and the ambient temperature may be high (for instance, at a beach location), so it is desired to keep the perishable food in a temperature-controlled environment to avoid spoiling. Similarly, beverages (such as canned beverages) may also be consumed, and it is desired to keep such beverages cool until consumption. Typically, a storage container may be used to transport the food and beverages while maintaining them in a temperature-controlled or temperature-protected environment. Storage containers and insulated storage containers may also be used for a variety of other purposes or activities including hunting, fishing, camping, medical purposes, working at remote locations, general storage, food delivery, and/or other business purposes.

Ice and/or cooling packs may be placed in an interior portion of a storage container defined by the side walls and bottom wall to keep the interior portion of the storage container at a desired temperature that is lower than the ambient temperature. In other situations, storage containers may be used to keep one or more items warmer or hotter than the ambient environment.

In many situations it is desirable to conveniently carry the storage container from one location to another. It may be desirable to carry the storage container in different ways depending on factors such as how heavily the storage container is loaded, the person(s) carrying the storage container, whether the person(s) are carrying other items, the distance it is to be carried, the terrain being covered, and/or the type of items in the storage container. In some situations, it may be desirable to carry the storage container for an extended period as part of an activity, such as while hiking, camping, trekking, hunting, fishing, and/or for military activities. In some situations, it may be desirable to have one or more portions of the storage container be made from a flexible, or semi-flexible, material in order to make it more comfortable and/or convenient to carry. Improved portable storage containers are provided herein which provide improved features in these respects.

SUMMARY

Storage containers are used for a variety of purposes and in conjunction with a variety of activities. In some examples the storage containers disclosed herein may assist in keeping one or more items cool, cold, frozen, warm, or hot. The storage container may also be used to protect one or more items from damage, bumps, scratching, impact, water, rain, snow, mud, dust, dirt, light, visibility, theft, chemicals, and/or contaminants. A storage container of the type disclose herein may be used for storage or transportation purposes and may not necessarily include insulating characteristics. The storage container may be configured to be carried or transported in a plurality of ways or configurations.

In one example, a portable insulated storage container includes a body which has an outer liner, an inner liner positioned inside the outer liner, the inner liner defining an internal storage volume inside the portable insulated storage container, and an opening extending through the outer liner and the inner liner for accessing the internal storage volume from outside the portable insulated storage container. The portable insulated storage container may also contain insulation positioned between the inner liner and the outer liner for thermally insulating the internal storage volume. The storage container also includes a closure mechanism attached to the body at the opening. The closure mechanism is configured for selectively providing access to the internal storage volume through the opening when the closure mechanism is an opened position and configured for closing the opening when the closure mechanism in a closed position. The closure mechanism comprises a first rigid member hingedly attached to a second rigid member. The first rigid member and the second rigid member define a perimeter of the opening and are configured to hingedly pivot about an axis to transition the closure mechanism from the closed position to the opened position. The closure mechanism may be configured to selectively maintain the opened position without application of an external force to the portable insulated storage container.

Other variations and embodiments are possible, including other variations and embodiments disclosed herein and including variations and embodiments which do not necessarily include all of the elements described above and/or variations or embodiments which may include additional elements.

DETAILED DESCRIPTION

Figure 1:
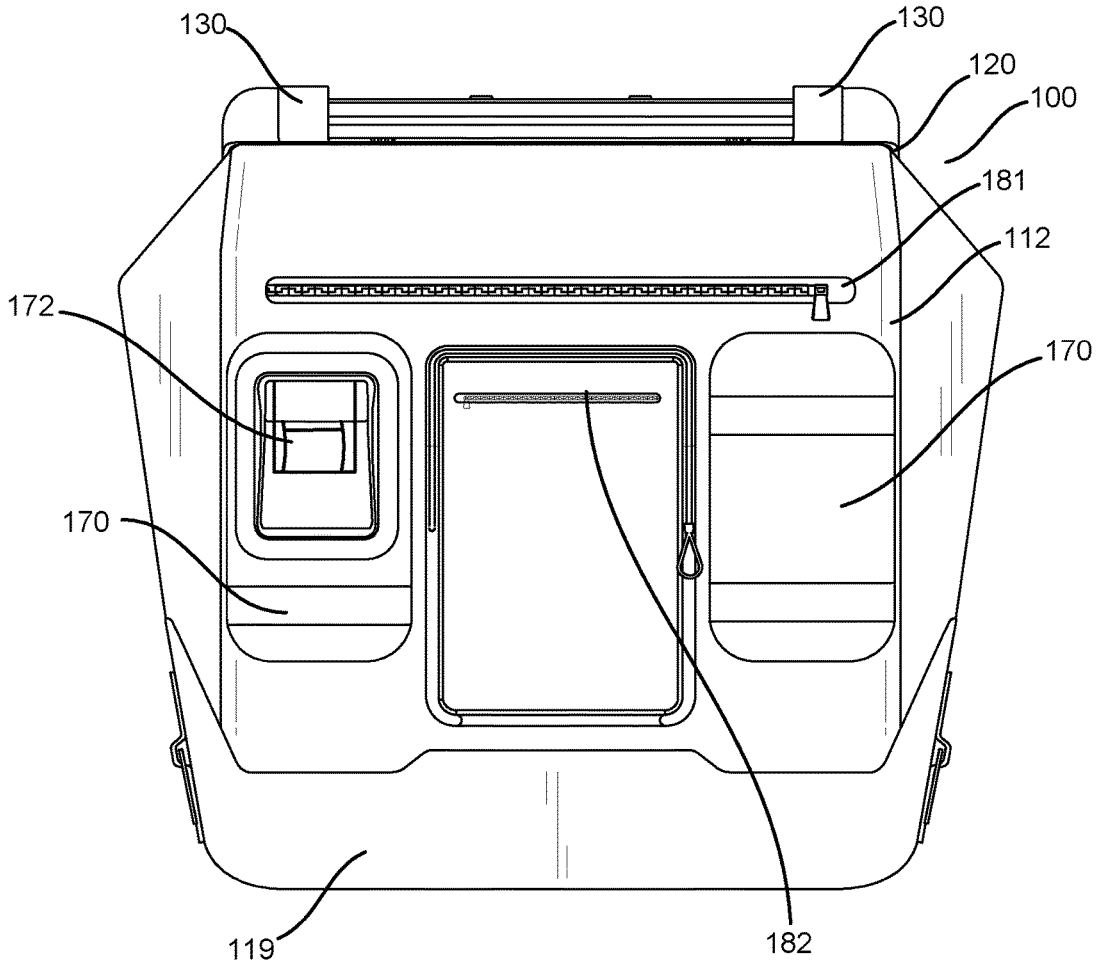
FIG. 1 illustrates a front view of a portable insulated storage container in accordance with the improvements presented herein.

FIG. 1 illustrates a front view of a portable insulated storage container 100. Portable insulated storage container 100 includes an outer shell 112. Outer shell 112 may be rigid or may be flexible. Outer shell 112 may comprise one or more textiles, fabrics, canvas, nylon, ballistic nylon, Kevlar, plastics, and/or rubber to form an outer shell for portable insulated storage container 100. Portable insulated storage container 100, or portions of portable insulated storage container 100, may be flexible, bendable, soft, compliant, stretchable, and/or compressible. In some cases, portable insulated storage container 100 may be partially or fully collapsible when not in use. Outer shell 112 may comprise more than one piece or section of material and the various pieces or materials may be attached using one or more methods including sewing, gluing, adhesive, electro-welding, thermoplastic welding, co-molding, melting, and/or fasteners. In some embodiments, some or all of outer shell 112 may contain multiple layers of materials. In some cases, each layer may provide different characteristics to the overall assembly, such as, for example, water resistance, abrasion resistance, padding, insulation, color, and/or visual features. In some examples, any combination of two or more of an inner liner, an outer shell, and insulation may be referred to as an insulating or insulated shell.

Outer shell 112 may be waterproof, water-resistant, abrasion resistant, tear resistant, and/or puncture resistant. Portable insulated storage container 100 includes an internal storage volume for carrying or storing one or more items (discussed in further detail with respect to FIGS. 7A and 7B). Portable insulated storage container 100 may also include a bottom cover, base, base area, baseplate, plate, or tray, such as bottom 119, comprising a material that is more rigid, more durable, and/or more resilient than one or more materials making up other portions of portable insulated storage container 100. Bottom 119 may serve to better protect a portion of portable insulated storage container 100 that is most commonly in contact with other items or surfaces and/or may provide a relatively flat, substantially flat, or primarily flat surface better enabling portable insulated storage container 100 to remain in a standing position for loading, unloading, and/or for storage.

Portable insulated storage container 100 also includes a closure mechanism 120 for opening and closing an opening which provides access to the interior storage compartment, storage volume, or storage area of portable insulated storage container 100. Closure mechanism 120 may provide a closure that is waterproof, water-resistant, childproof, child resistant, animal proof, and/or animal resistant. Closure mechanism 120 may include one or more components made of plastic, metal, wood, ceramic, rubber, and/or silicone. Further, closure mechanism 120 may include a locking mechanism or an interface for use with one or more locks. The one or more locks may be integrated with or separate from portable insulated storage container 100. Operation of closure mechanism 120 is discussed in further detail with respect to subsequent figures.

Also partially visible in FIG. 1 is a strap 130 for carrying portable insulated storage container 100. The configuration of strap 130 may be adjusted or changed through operation of closure mechanism 120. The various portions, uses, and configurations of strap 130 are discussed in further detail with respect to subsequent figures. Strap 130 may comprise fabric, nylon, ballistic nylon, plastic, rubber, Kevlar, and/or any flexible material. Strap 130 may also include metal components or hardware. Strap 130 may be a single piece of material or may be an assembly containing multiple components.

Portable insulated storage container 100 may also include one or more attachment areas, such as attachment points 170, for removably attaching one or more accessories or other items. Attachment point 170 may include any of a variety of attachment mechanisms, structures, or features including those described in U.S. patent application Ser. No. 15/398,468, filed Jan. 4, 2017, which is hereby incorporated by reference in its entirety. In one example, a bottle opener 172 is removably attached to one of attachment points 170.

In addition to the primary internal storage compartment, portable insulated storage container 100 may also include one or more other storage areas, storage pockets, or storage compartments, such as pocket 181 and pocket 182, for carrying other items. Pocket 181 and/or 182 may have a storage space that is not contiguous with the internal storage volume of portable insulated storage container 100. Pocket 181 and/or 182 may include a closure mechanism such as a zipper, hook and loop fastener, zip lock mechanism, button, and/or snap. Portable insulated storage container 100 may also include one or more other accessories, such as a rechargeable battery, a solar cell, a light, a liquid storage bladder, a first aid kit, a storage container, a tool, and/or a toolkit. One or more of these other accessories may be stored in, accessed in, and/or accessed through pocket 181 and/or pocket 182. Further, portable insulated storage container 100 may include one or more pockets or compartments for storing a cold pack, hot pack, or ice pack for helping to maintain temperature of the contents. In some configurations, one or more of the disclosed pockets or compartments may be on an interior surface of portable insulated storage container 100.

In some examples, one or more pockets may also be sized to hold a portable electronic device, such as a smartphone. In some examples, one or more pockets may include a transparent window for viewing contents of the pocket without opening the pocket. One or more pockets may also be waterproof or water resistant relative to external elements, as well as to the contents of the storage container. One or more attachment features or points may also be included for attaching accessories, such as a carabineer, flashlight, or speaker, to an external surface of portable insulated storage container 100.

Figure 2:
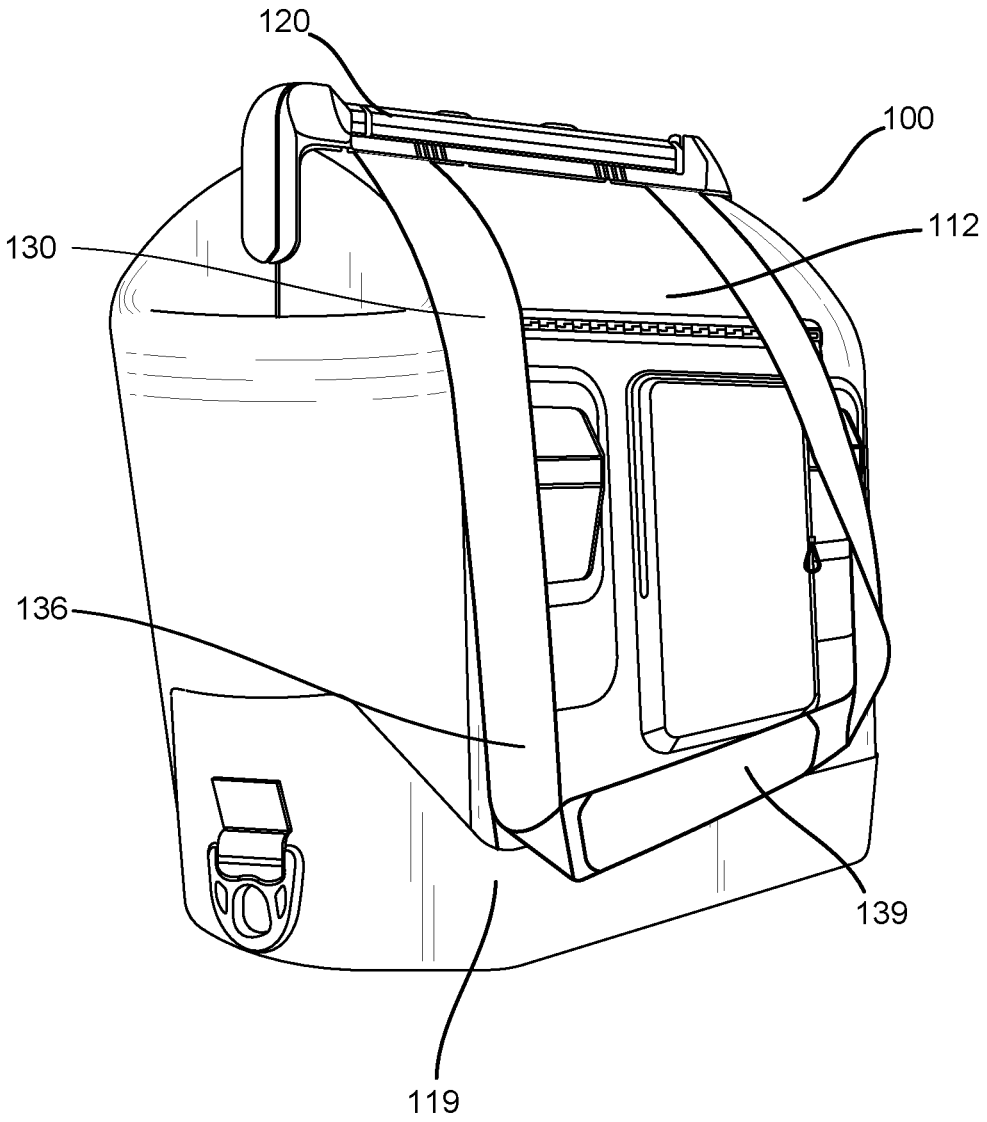
FIG. 2 illustrates a front perspective view of the portable insulated storage container of FIG. 1.

FIG. 2 illustrates a front perspective view of portable insulated storage container 100. In the view of FIG. 2, and relative to FIG. 1, a shoulder strap portion 136 of strap 130 is flipped over and hanging over the front of portable insulated storage container 100. Shoulder strap portion 136 may be used for carrying portable insulated storage container 100 over one shoulder and/or for hanging it from a hook or knob. Shoulder strap portion 136 may include an additional shoulder pad or attachment, such as shoulder pad 139, for reducing irritation or isolated pressure on a shoulder or other body part when carrying portable insulated storage container 100. Any other portion of portable insulated storage container 100 may also include padding or a padded area for reducing irritation or pressure against a body part or other area that it comes into contact with while in use.

Figure 3:
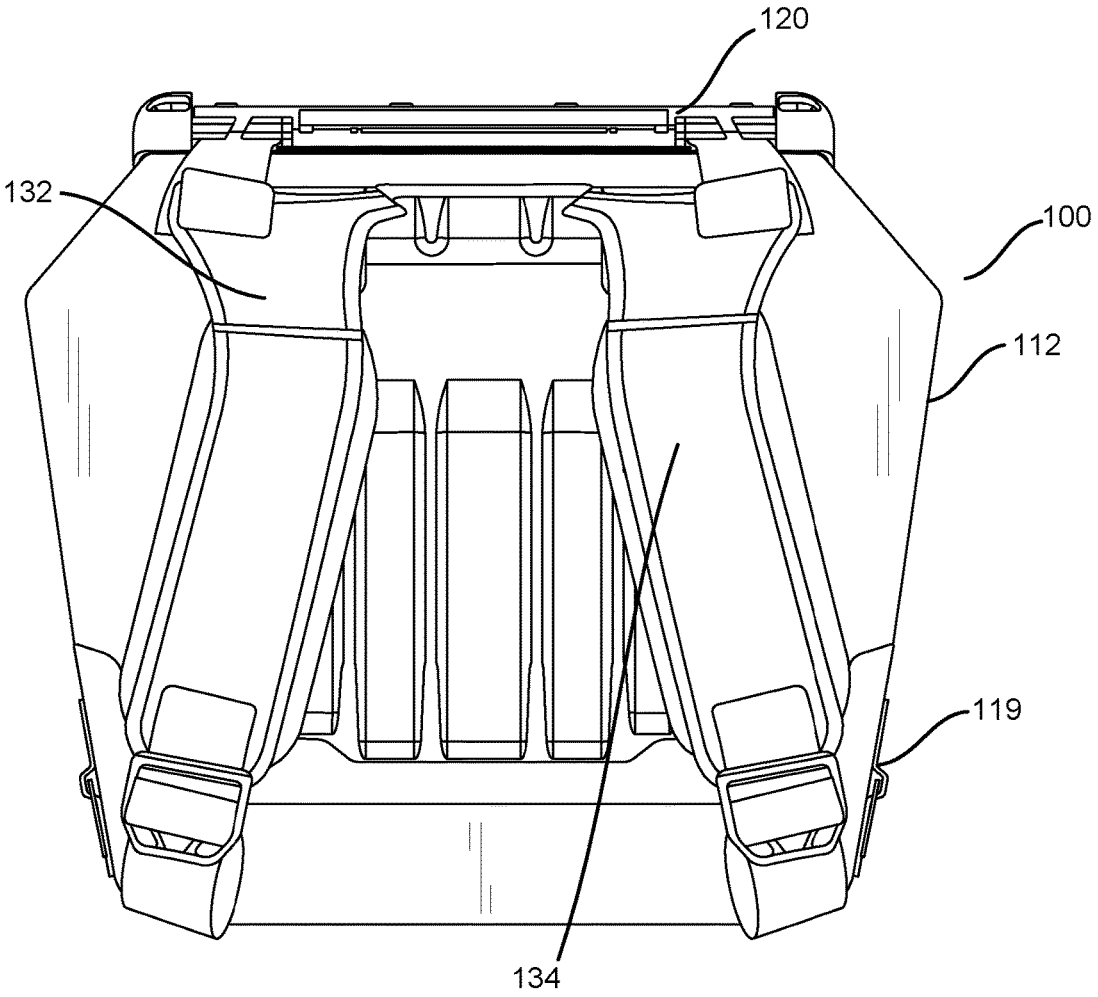
FIG. 3 illustrates a back view of the portable insulated storage container of FIG. 1.

FIG. 3 illustrates a back view of portable insulated storage container 100 which shows at least a portion of a back of portable insulated storage container 100. FIG. 3 illustrates backpack strap portions 132 and 134 of strap 130. Each of backpack strap portions 132 and 134 is connected, either permanently or removably, to a lower portion or near the bottom of portable insulated storage container 100 and extends through opposing sides of closure mechanism 120 to meet and form should strap portion on the opposite side of closure mechanism 120. In other words, strap 130 may be a single piece or strap assembly that is divided into three sections (two backpack strap portions and one should strap portion) by closure mechanism 120. Backpack strap portions 132 and/or 134 may be used to carry portable insulated storage container 100 on one's back like a backpack. Beneficially the backpack strap portions 132 and 134 can be shortened to the extent that they have little or no slack and are flat against the surface of portable insulated storage container 100 when not in use as a backpack such that they are not in the way and the possibility of them getting caught or snagged on other items is significantly reduced. In some examples, lengths of backpack strap portions 132 and/or 134 may be adjustable as described herein without relying on closure mechanism 120.

Figure 4:
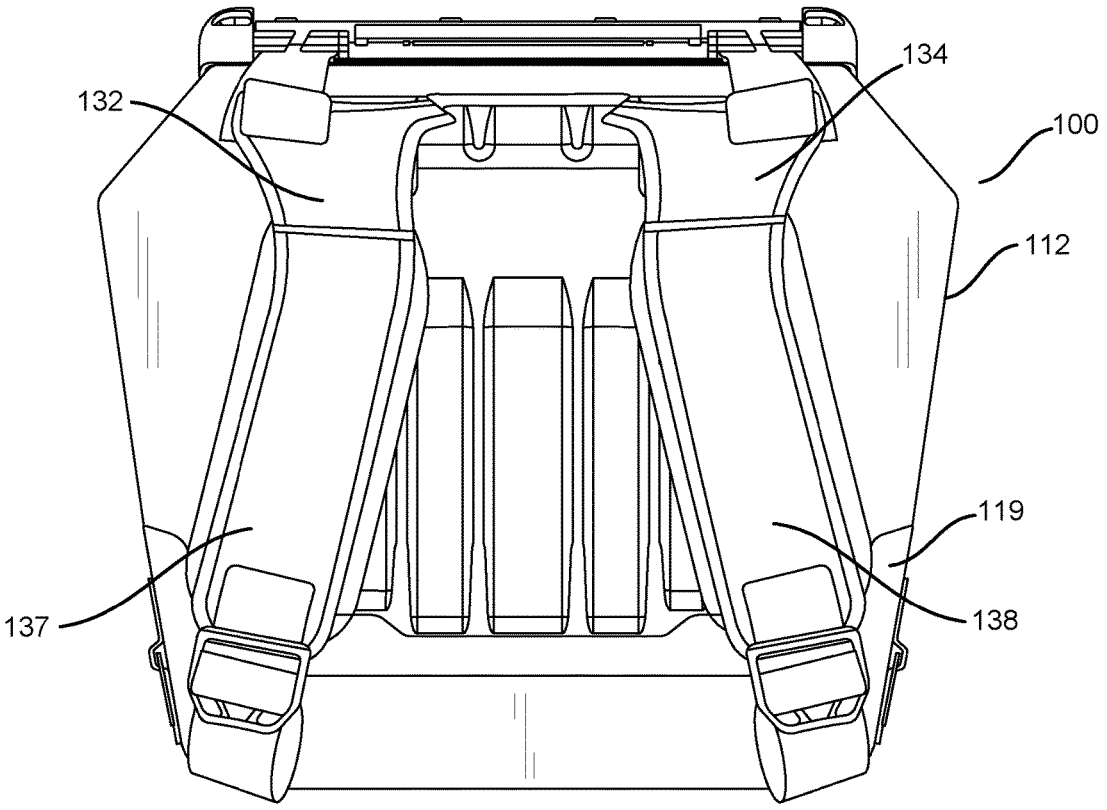
FIG. 4 illustrates another back view of the portable insulated storage container of FIG. 1.

FIG. 4 illustrates a back view of portable insulated storage container 100. FIG. 4 illustrates that the one or more of backpack strap portions 132 and/or 134 may contain a pad, such as adjustable pads 137 and 138, for reducing irritation or isolated pressure when carrying portable insulated storage container 100 with backpack strap portions 132 and/or 134. In some examples, one or more additional straps may bridge or extend between backpack strap portions 132 and 134. These one or more additional straps may serve to keep backpack strap portions 132 and 134 in place or spaced by a preferred distance when portable insulated storage container 100 is being carried. The one or more additional straps may also serve as a carrying handle in some instances. The one or more additional straps may each have two components that are removably attached to each other by a clasp and one or both components may be adjustable in length.

Figure 5:
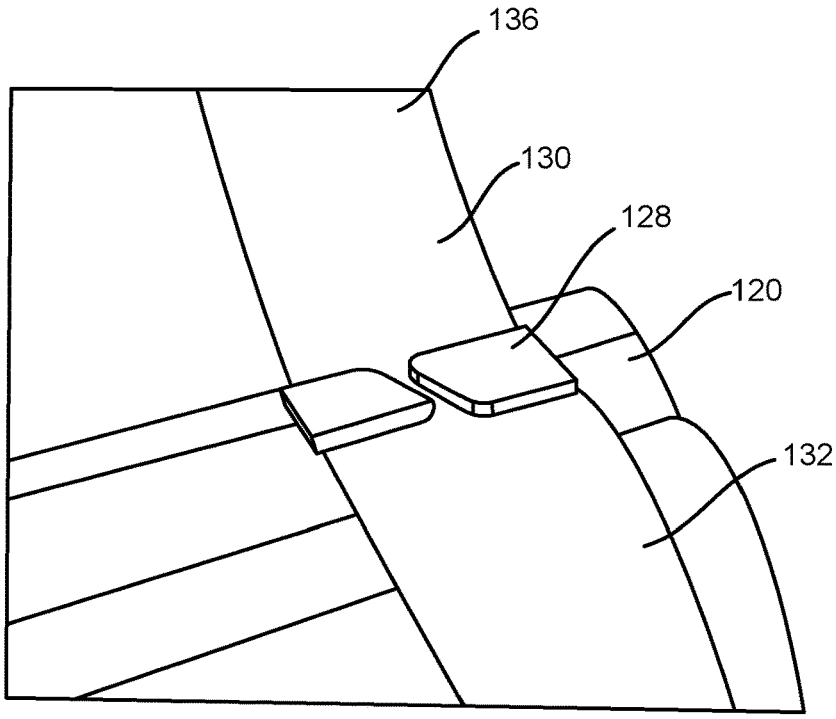
FIG. 5 illustrates a close-up view of a portion of the closure mechanism of the portable insulated storage container of FIG. 1.

FIG. 5 illustrates a close-up view of a portion of closure mechanism 120 of portable insulated storage container 100. Closure mechanism 120 is in an open position in FIG. 5 which allows strap 130 to slide through closure mechanism 120. Closure mechanism 120 may include a strap retention feature 128 which allows strap 130 to slide back and forth for positioning relative to closure mechanism 120 while still being movably retained by closure mechanism 120 unless a more deliberate effort is made to remove strap 130 from closure mechanism 120. Moving strap 130 changes the amounts of strap 130 that are allocated to shoulder strap portion 136 and backpack strap portion 132 thereby inversely changing the lengths of each. If one of shoulder strap portion 136 and backpack strap portion 132 is lengthened then the other is shortened, and vice-versa. The opposing end of closure mechanism 120 includes a similar structure relative to backpack strap portion 134. Beneficially, the lengths of the various straps can be quickly and easily adjusted to suit various uses and carrying situations.

One or more of shoulder strap portion 136, backpack strap portion 132, and backpack strap portion 134 may also include a length adjusting feature, such as a slide buckle, in addition to length adjusting features described above with respect to closure mechanism 120.

Figure 6:
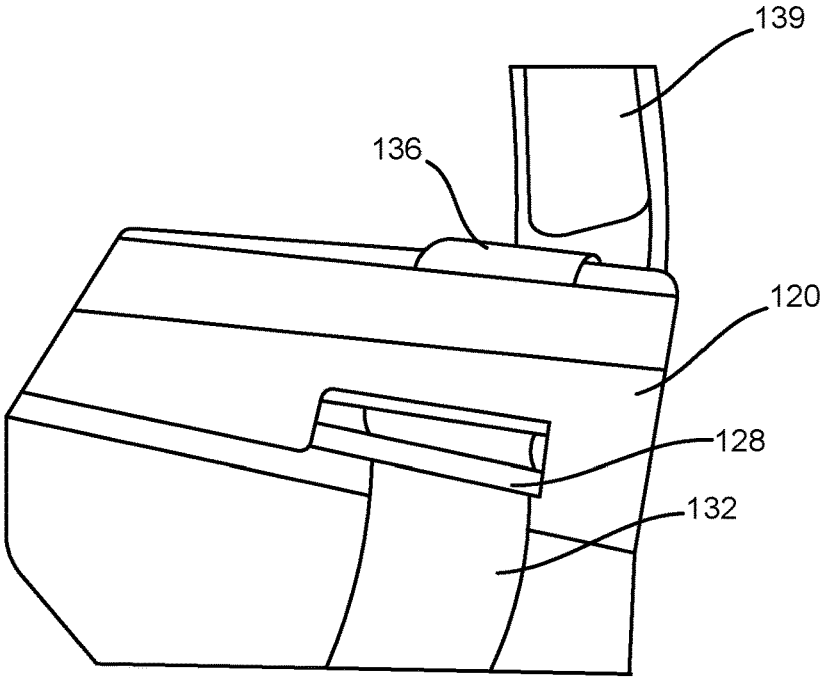
FIG. 6 illustrates a close-up view of a portion of the closure mechanism of the portable insulated storage container of FIG. 1.

FIG. 6 illustrates a close-up view of a portion of the closure mechanism 120 of portable insulated storage container 100 with closure mechanism 120 in a closed position. Securing closure mechanism 120 in a closed position not only closes the storage volume (as discussed further with respect to FIG. 7A), but also clamps strap 130 and keeps shoulder strap portion 136 and backpack strap portions 132 and 134 at their selected lengths, at least until closure mechanism 120 is opened or released and they are further adjusted. In other words, closure mechanism 120 provides access to the storage area, secures the storage area, and retains the various portions of strap 130 at desired lengths.

In some examples, some or all portions of closure mechanism 120 may be separate from any features or components associated with clamping, adjusting, retaining, securing, or holding any of straps 130, shoulder strap portion, and/or backpack strap portions 132 and 134. In other words, any or all of the straps or strap adjustment features may be included on portable insulated storage container 100 separately from closure mechanism 100.

Figure 7A:
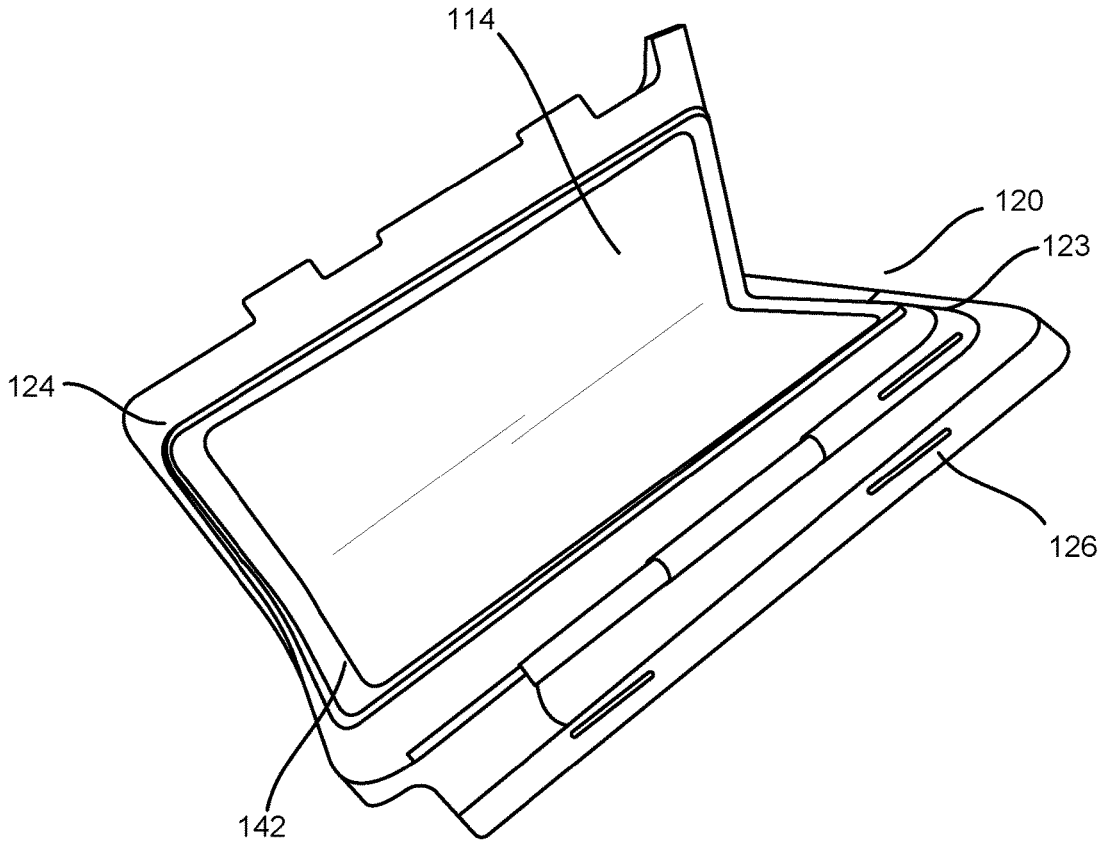
FIG. 7A illustrates the closure mechanism and inner liner of the portable insulated storage container of FIG. 1.

FIG. 7A illustrates closure mechanism 120 and inner liner 114 of portable insulated storage container 100. Outer shell 112 is not included in FIG. 7A for illustration purposes. Inner liner 114 is viewed through an opening of portable insulated storage container 100 that is provided when closure mechanism 120 is in the opened position illustrated in FIG. 7A. Inner liner 114 defines an interior storage compartment or storage area 122 of portable insulated storage container 100. In some examples, inner liner 114 may be removable and/or replaceable. In other examples, inner liner 114 may be treated with an antimicrobial or antibacterial coating.

As illustrated in FIG. 7A, closure mechanism 120 may comprise two primary frame members or closure portions, such as first member 123 and second member 124, which are operable between at least a closed position and an open position. First member 123 and second member 124 are each formed from a rigid or semi-rigid material and hingedly attached to each other. In one example, first member 123 and second member 124 are attached to each other with two living hinges (not visible in FIG. 7A) formed from plastic. Other types of hinges, hinging elements, and/or configurations are possible. In some cases, first member 123 and second member 124 may not be directly attached to each other with a hinge mechanism.

Each of first member 123 and second member 124 may have a rectangular shape with an open side or may have a "C" shape or an "open-D" shape such that the two members form a closed shape around a perimeter of the opening when attached to each other. Each of first member 123 and second member 124 may pivot or rotate relative to each other and/or relative to an axis to provide a 'coin purse' or 'doctor's bag' type opening and closing mechanism. In some examples, each member may pivot in an opposite direction from the closed position to form the opening. In some examples, each member may pivot in opposite directions approximately 90 degrees from the closed position such that the two members are substantially in the same plane when in the opened position. The opening of outer shell 112 and/or inner liner 114 may be inherently rectangular in shape when not affected by other forces and this rectangular opening may coincide with perimeter dimensions of the opening formed by the two attached members of closure 120 when they are in the opened position. In other words, outer shell 112 and/or inner liner 114 may have the shape of a three-dimensional orthotope or a hyperrectangle with one open end that gets 'pinched' together when the closure mechanism is closed.

When in the open position, first member 123 and second member 124 provide easy access to the storage area of portable insulated storage container 100 by temporarily forming an opening defined by first member 123 and second member 124. This type of opening may provide benefits to an opening which does not necessarily include rigid components, such as a zipper opening, because the opening temporarily stays in place and allows a user to easily see inside the storage compartment, put items in and out of the compartment, and/or use both hands to reach into the compartment without having to use one hand to hold the opening open.

One or more types of insulation (not visible in FIG. 7A) may be included between inner liner 114 and outer shell 112 for keeping one or more items inside storage area 122 warm, hot, cool, or cold. The insulation may be positioned between inner liner 114 and outer shell 112 and may be attached to one or both of inner liner 114, outer shell 112, closure mechanism 120, first member 123, and/or second member 124. The attachment, if any, may be in one location or in many locations and may be accomplished using one or more of glue, an adhesive, a fastener, clamping, electro-welding, and/or thermoplastic welding. The attachment may be permanent, semi-permanent, or removable.

In some examples, the disclosed storage containers may be used only for storage purposes and may not include insulation. Inner liner 114 may be waterproof or water-resistant such that melted ice, liquid, condensation, odors, and/or steam inside the storage area 122 does not leak through portable insulated storage container 100. In other examples, some or all of the insulation may be removable and/or replaceable. Portable insulated storage container 100 may be designed to alternately accept two or more different types of insulation that provide alternate and/or configurable performance and cost options. In one example, a basic insulation may be replaceable with a higher performance, and possibly higher cost, alternative insulation. Portable insulated storage container 100 may be configured such that exchange or removal of some or all of the insulation may be performed at the time of manufacture, after manufacture, and/or may be repeatedly performed by an end user of the product.

Inner liner 114 may form a perimeter of the opening of the storage area 122 and may be attached to and/or wrap around a lip or edge of closure mechanism 120. Inner liner 114 may attach, seal, or adhere directly to closure mechanism 120. Closure mechanism 120 may also include one or more gaskets or seals, such as gasket 142, which are compressible for sealing the opening when the closure mechanism is in a closed position. Gasket 142 may be affixed directly to inner liner 114 in order to minimize the possibility of leak paths. In one variation, gasket 142 may comprise two or more gaskets or a gasket having two or more segments. In another variation, gasket 142 may span or be affixed to only one of first member 123 and second member 124 and may come in contact with the other of first member 123 and second member 124 when in the closed position. In another example, gasket 142 may be created as a formed-in-place gasket. Closure mechanism 120 may have one or more clasping features, such as lever 126, for transitioning closure mechanism 120 between the opened and closed position and/or retaining closure mechanism 120 in the opened or closed position.

Gasket 142 may seal the opening such that it is resistant to liquid leakage, thermal leakage, and/or odor leakage when closure mechanism 120 is in the closed position. In addition to the other uses described herein, these features may also be convenient for carrying game or fish while hunting or fishing. Gasket 142 and/or one or more other seal features or components may also provide resistance to dust, water, snow, rain, mud, chemicals, and/or contaminants when in the closed position. Gasket 142 may provide sufficient sealing force to keep liquid inside portable insulated storage container 100 from leaking out even if portable insulated storage container is laid on its side, turned upside down, and/or subject to internal pressure or external forces. In some examples, one or more of first member 123 and second member 124 may include a gasket seat or gasket seating area configured for sealing the opening.

In other examples, closure mechanism 120 may use one or more other mechanical devices for keeping closure mechanism 120 in the closed position including a zipper, a clip, a snap, a latch, a clamp, a cam-over mechanism, and/or a mechanical interference structure. In one example, a waterproof or water resistant zipper may be used. In this example, a zipper may also perform a sealing function and gasket 142 may not be needed. In other examples, a rolled waterproof closure, a zip lock closure, a magnetic, and/or a compression closure may be used. In some examples, closure mechanism 120 may be or include a zipper, a water-resistant zipper, a waterproof zipper, and/or zip-lock features.

Figure 7B:
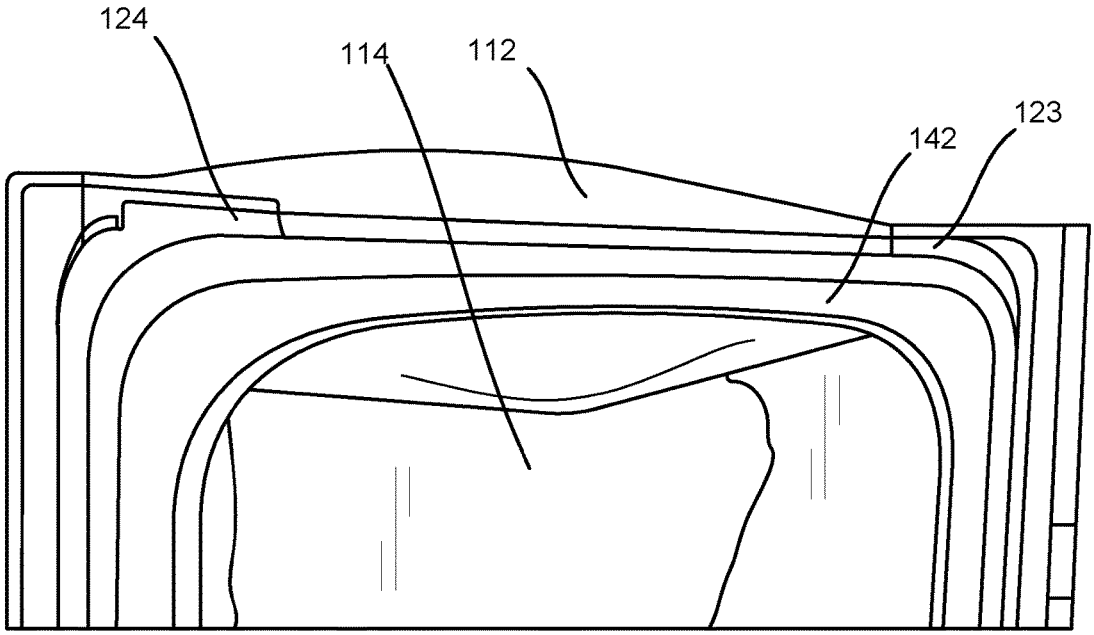
FIG. 7B illustrates a close up view of the a portion of the closure mechanism of the portable insulated storage container of FIG. 1.

FIG. 7B illustrates a close up view of a portion of the closure mechanism 120 of portable insulated storage container 100 in the open position. As described with respect to FIG. 7A, first member 123 and second member 124 hingedly pivot with respect to each other to transition between the open position and the closed position. The pivoting may occur about an axis and the axis may pass through the hinge members or hinging points. Inner liner 114 and outer shell 112 may be attached, adhered, or affixed to one or more of first member 123 and second member 124 such that portable insulated storage container is sealed when closure mechanism 120 is in the closed position. Beneficially, this design provides an accessible, sealable compartment with a reduced number of components.

Figure 8:
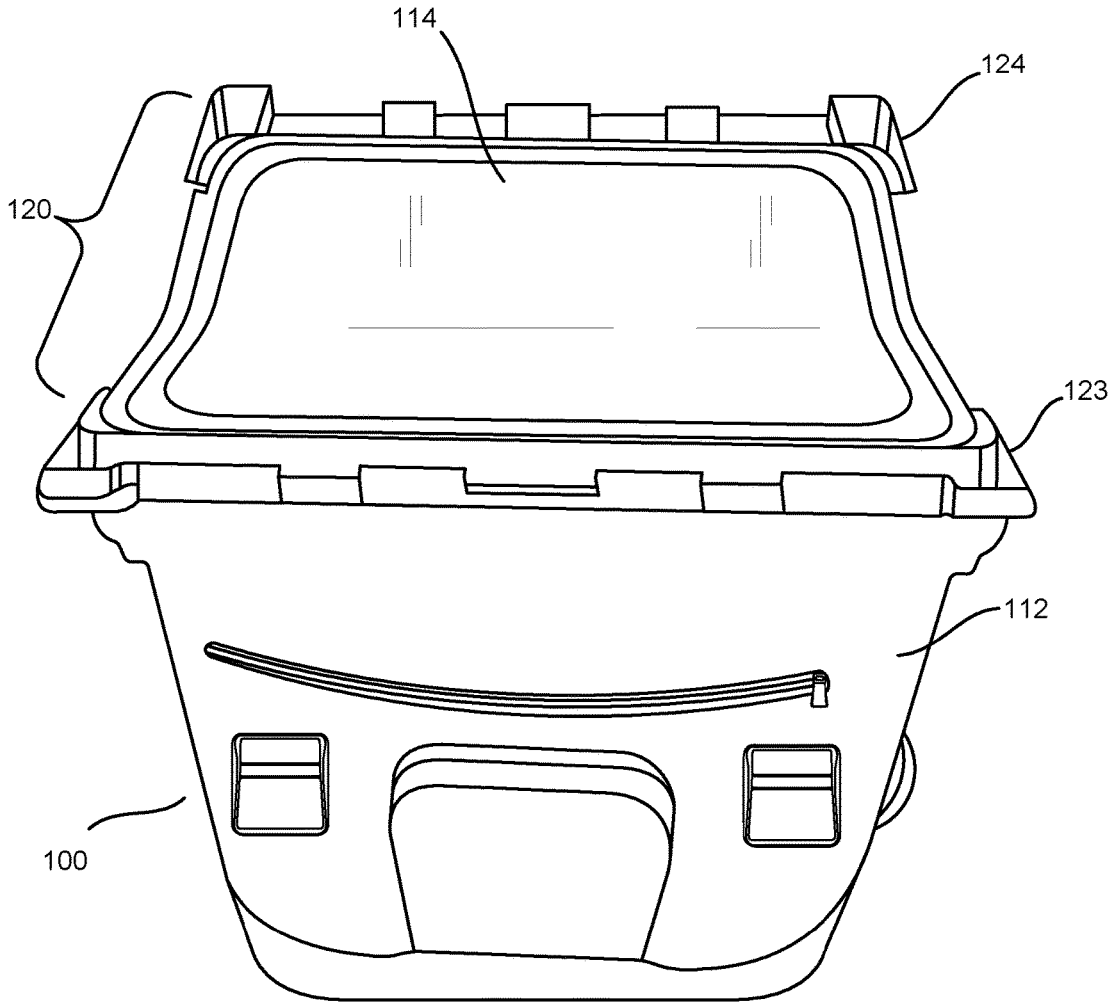
FIG. 8 illustrates the portable insulated storage container of FIG. 1 in the open position.

FIG. 8 illustrates portable insulated storage container 100 in an open position. As described with respect to previous figures, closure mechanism 120 provides selective access to the internal storage volume of portable insulated storage container 100. As discussed with respect to FIG. 7A, first member 123 and second member 124 of closure mechanism 120 hinge or pivot away from each other to form the opening to the internal storage volume. Each of first member 123 and second member 124 may pivot approximately 90 degrees, in opposite directions from each other, to transition from the closed to the fully open position. In the fully open position, first member 123 and second member 124 are oriented approximately 180 degrees with respect to each other to form an opening that is planar, substantially planar, or approximately planar. In some examples, the opening may be approximately a same size as the bottom surface of storage container 100. In other examples, the sides may be tapered and the opening may be larger than the bottom surface of storage container 100.

Shell 112 and liner 114 each have an opening that is approximately or primarily rectangular in shape. These rectangular openings define the rectangular opening into the internal storage volume of insulated portable storage container 100. This rectangular shape exists when the sides of shell 112 and/or liner 114 are each primarily vertical and each in a mostly planar configuration. In this configuration, shell 112 is a three-dimensional orthotope or a hyperrectangle with a rectangular opening on the top end.

Figure 12:
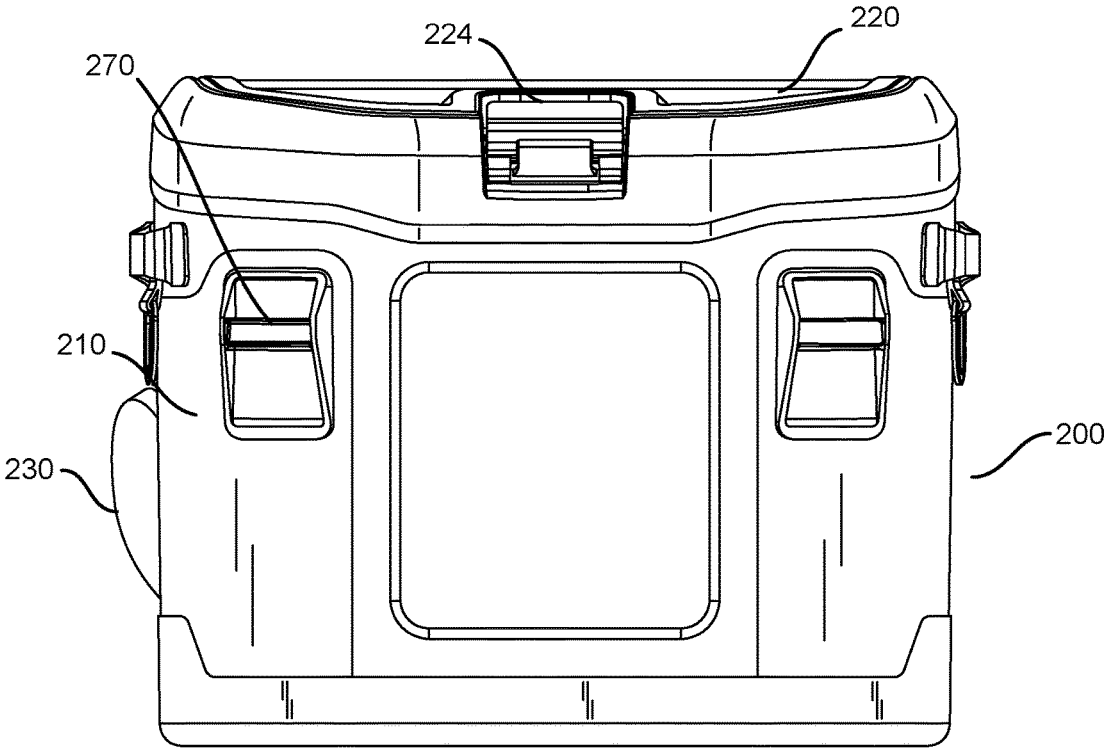
FIG. 12 illustrates a front view of an alternate embodiment of a portable cooler.

First member 123 and second member 124 may be sized such their combined perimeter in the fully open position corresponds to the opening of shell 112 and/or liner 114 as illustrated in FIG. 12. Although first member 123 and second member 124 are attached to shell 112 and/or liner 114, they permit shell 112 and/or liner 114 to return to the hyperrectangle shape when in the open position. In this way, the size of the opening is increased or maximized in order to make it easier to access the internal storage volume. The opening tends to remain in this open position without being held in place since the sides or walls of shell 112 and liner 114 are in their natural, default, relaxed, or non-folded planar positions which correspond to the rectangular opening. The rigid, or semi-rigid, structure of first member 123 and second member 124 further tend to keep the opening in a rectangular, primarily rectangular, or mostly rectangular shape.

Figure 9:
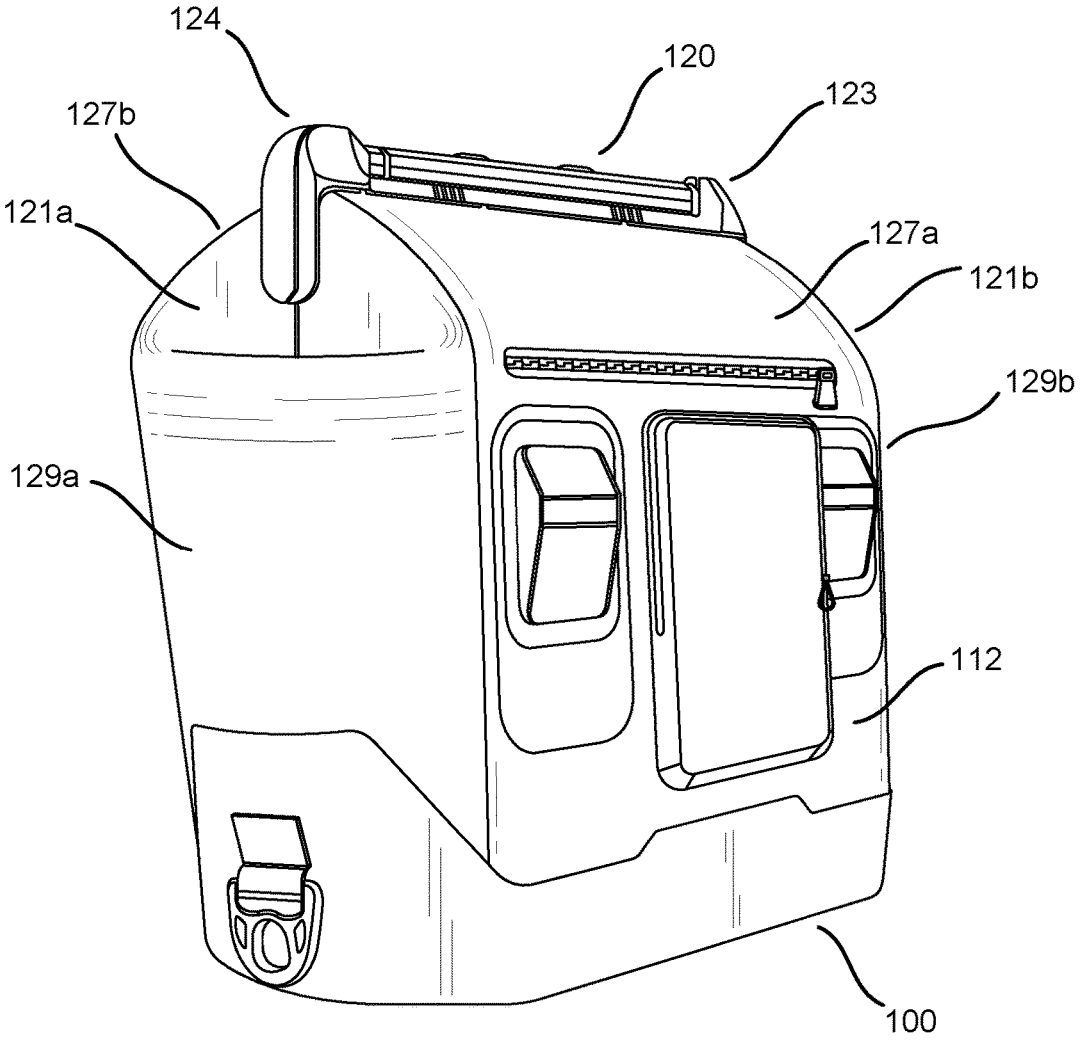
FIG. 9 illustrates a front perspective view of the portable insulated storage container of FIG. 1 in the closed position.

FIG. 9 illustrates a front perspective view of portable insulated storage container 100 in the closed position. When first member 123 and second member 124 are brought together to close the opening, two opposing primary sides 127*a* and 127*b* of shell 112 are bent toward each other (side 127 *b* not directly visible in FIG. 13). Each of the ends of the two opposing secondary sides 129*a* and 129*b* are folded in half onto or over themselves as a result of being attached to respective portions of first member 123 and second member 124, which pivot toward each other (side 129*b* not visible in FIG. 13). This action causes closure of all four sides (127*a*, 127*b*, 129*a*, and 129*b*) of the opening. The closing of the opening causes cupped areas or pockets 121*a* and 121*b* to be formed in secondary sides 129*a* and 129*b*, respectively (pocket 121*b* not visible in FIG. 13).

In addition to being waterproof, water-resistant, wear-resistant, puncture-resistant, and/or abrasion resistant, material used to form shell 112 must be somewhat flexible in order to bend to form pockets 127*a* and 127*b* when insulated portable storage container 100 is closed. At the same time, the material has elasticity and/or shape memory that cause the sides to tend to return to their original planar, or near-planar, shapes. The forming of pockets 121*a* and 121*b* during closing requires overcoming these forces. Furthermore, these forces also tend to exert an assistive or springing force tending to push members 123 and 124 to the open position illustrated in FIG. 8 once the opening processes has been started. In other words, the inherent tendency of the shell and liner materials to flatten results in an inherent tendency or bias to eliminate pockets 121*a* and push the apparatus to the open position. This results in an inherent biasing or spring assistance force tending to push closure mechanism 120 to the open position.

Beneficially, the biasing or spring assistance force helps a user to open closure mechanism 120 more quickly and/or with less applied force. Further, it causes closure mechanism 120 to fully open with a more positive 'snap' and tends to hold it more positively in the open position making it easier for a user to access the internal storage volume. These springing forces, along with the rigidity of members 123 and 124 results in the open configuration of FIG. 8 being stiffer than it would be otherwise. Beneficially, it may also require a greater force to begin closing it, thereby reducing accidental closure if bumped or disturbed while accessing the interior.

Figure 10:
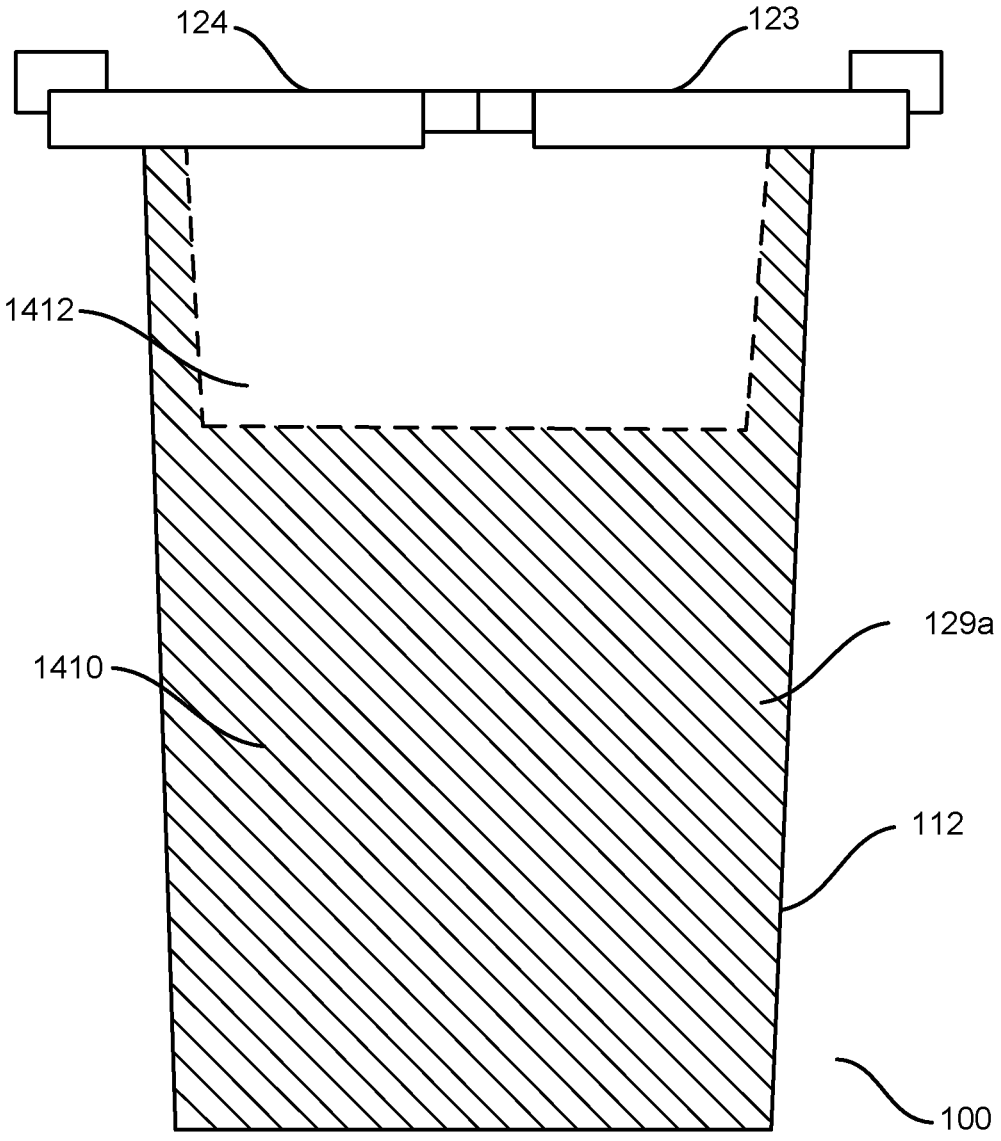
FIG. 10 illustrates insulation in a side of the portable insulated storage container of FIG. 1.
Figure 14:
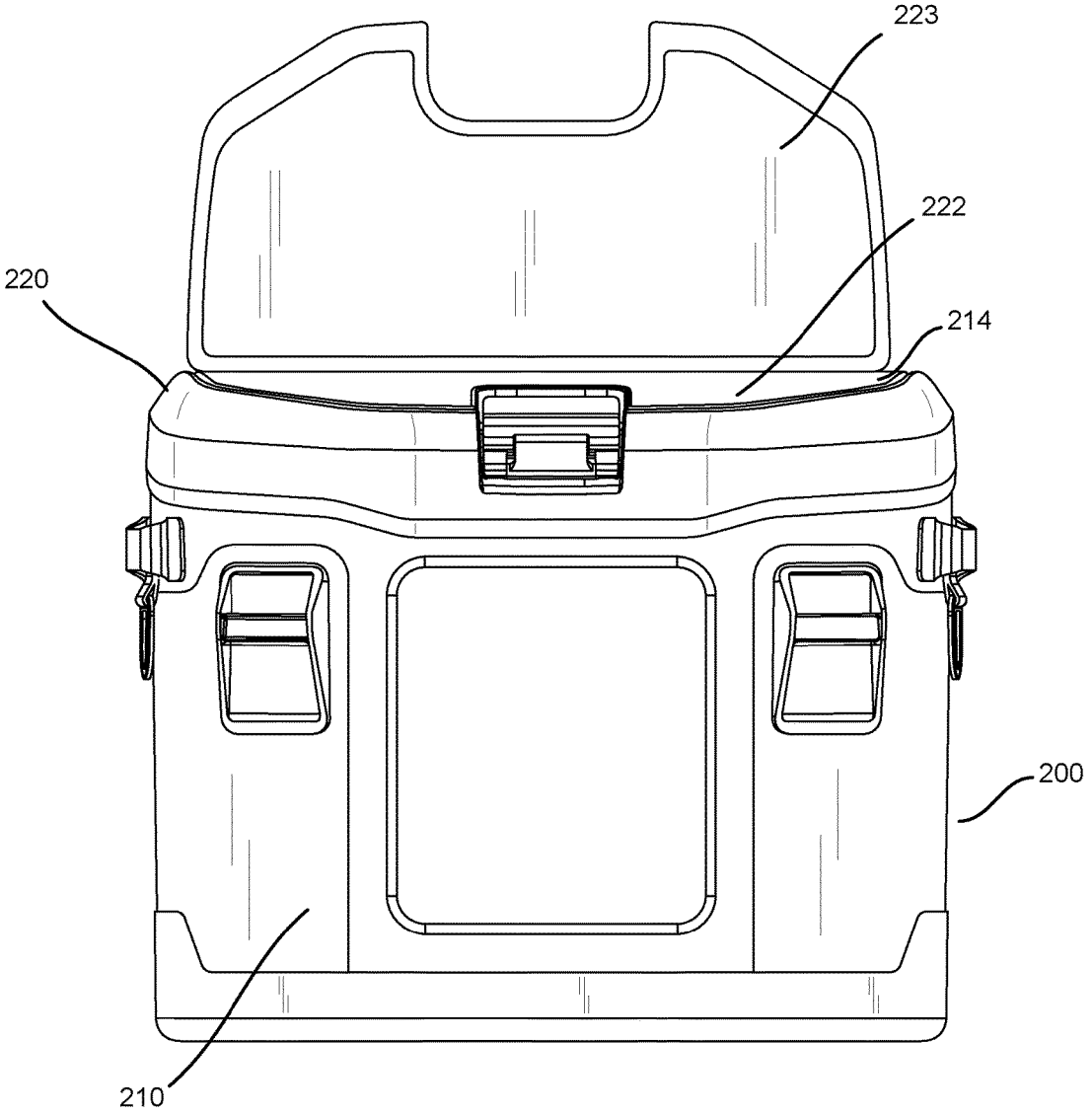
FIG. 14 illustrates a view of the portable cooler of FIG. 12 with the lid opened.

FIG. 10 illustrates insulation 1410 which may be used in a side of portable insulated storage container 100 of FIG. 1. In FIG. 14, portable insulated storage container 100 is seen from a side view in the open position. Insulation 1410 is placed between inner liner 114 and shell 112 for insulating the walls of portable insulated storage container 100. Insulation 1410 may comprise any one or more types of insulating material, including foam, closed cell foam, cellulose, polystyrene, and/or a vacuum insulated panel. Insulation 1410 is illustrated in FIG. 10 using shading or crosshatching. However, insulation 1410 is only shown in FIG. 10 for explanation purposes and would not actually be visible because it is sandwiched between inner liner 114 and shell 112.

In the example of FIG. 14, insulation 1410 is illustrated as the insulation of secondary side 129*a*. As illustrated, insulation 1410 does not extend fully throughout secondary side 129*a* as there is a cutout area 1412 where insulation 1410 is not present. The lack of insulation in cutout area 1412 beneficially makes it easier to close portable insulated storage container 100 to the position illustrated in FIG. 9 by avoiding bunching or compression of the insulation in cutout area 1412 and/or pocket 121*a* that would occur were the insulation present in cutout area 1412. The illustrated insulation configuration may also assist with the springing or opening forces discussed above with respect to members 123 and 124. It should be understood that cutout area 1412 may have any size and/or shape, such as a rectangular, triangular, or a parallelogram, to better accommodate the size and shape of members 123 and 124, as well as accommodate the closing geometry and dimensions.

Figure 11A:
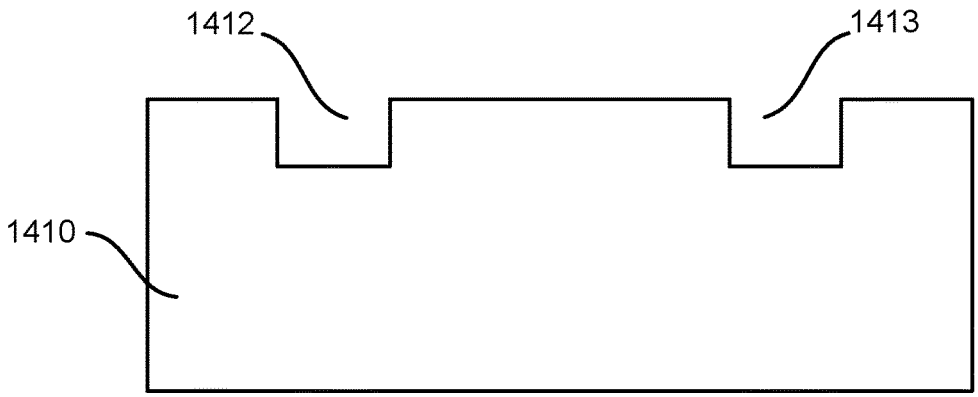
FIG. 11A illustrates one example of insulation used in the portable insulated storage container of FIG. 1.

FIG. 11A illustrates one example of insulation 1410 used in portable insulated storage container 100. The sheet of insulation 1410 illustrated in FIG. 11A is an initially flat, planar, nearly flat, or nearly planar, single sheet of material that gets bent or folded to span multiple sides of insulated portable storage container 100 after it has been assembled. Insulation 1410 of FIG. 11A includes cutouts 1412 and 1413 which align with secondary sides 129*a* and 129*b*, respectively, as discussed with respect to FIG. 10. FIG. 11A illustrates one configuration, but other configurations are possible.

Figure 11B:
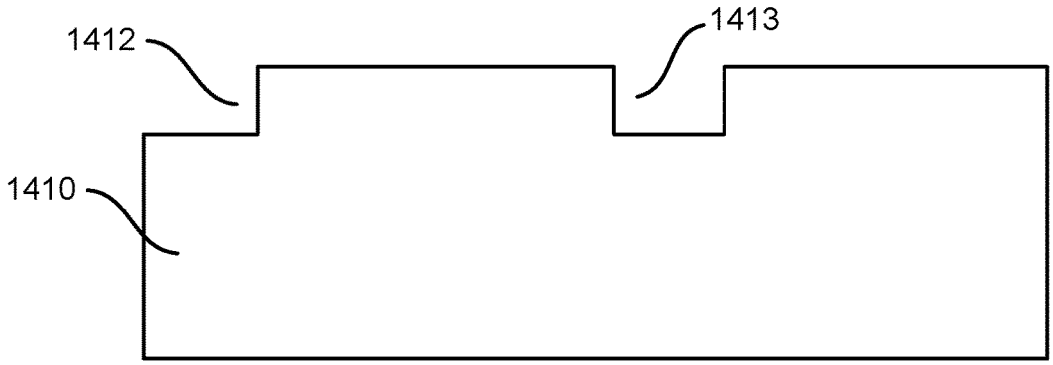
FIG. 11B illustrates another example of insulation used in the portable insulated storage contain of FIG. 1.

FIG. 11B illustrates a variation in which cutouts 1412 and 1413 are oriented in different locations on insulation 1410 but still align with secondary sides 129*a* and 129*b*, respectively when the insulation is installed between shell 112 and liner 114. It should be understood that other orientations and configurations are possible. While a single piece of insulation is illustrated in FIGS. 11A and 11B, it should be understood that multiple pieces or sheets of insulation are possible. The ends of insulation 1410 may be glued or adhered to each other and/or to one or more pieces of insulation used on the bottom of portable insulated storage container 100. Alternately, the structure illustrated in FIG. 11A or 11B may be formed along with a piece of bottom insulation. Insulation 1410 may also be adhered to liner 114, shell 112, and/or any other element of portable insulated storage container 100 in one or more locations.

The insulation configurations illustrated in FIGS. 11A and 11B may also be beneficial in forming pocket 121*a* and/or 121*b* when portable insulated storage container 100 is being closed. If a single piece of insulation is bent around the corners from one or more of the primary sides to one or more of the secondary sides, the insulation may tend to bow out slightly on the secondary sides (for example, insulation 1410 may bay bow outward from the page in the middle of the side illustrated in FIG. 14). Now, referring to FIG. 13, this outward bowing will tend to cause or assist pocket 121*a* in cupping inward and/or being formed in an inward direction relative to the outer portion of secondary side 129*a* when the cooler is closed such that the orientation illustrated in FIG. 9 occurs without any additional effort or input from the user.

In one example, a portable insulated storage includes a body which has an outer liner, an inner liner positioned inside the outer liner, the inner liner defining an internal storage volume inside the portable insulated storage container, and an opening extending through the outer liner and the inner liner for accessing the internal storage volume from outside the portable insulated storage container. The portable insulated storage container may also contain insulation positioned between the inner liner and the outer liner for thermally insulating the internal storage volume. The storage container also includes a closure mechanism attached to the body at the opening. The closure mechanism is configured for selectively providing access to the internal storage volume through the opening when the closure mechanism is an opened position and configured for closing the opening when the closure mechanism in a closed position. The closure mechanism comprises a first rigid member hingedly attached to a second rigid member. The first rigid member and the second rigid member define a perimeter of the opening and are configured to hingedly pivot about an axis to transition the closure mechanism from the closed position to the opened position. The closure mechanism may be configured to selectively maintain the opened position without application of an external force to the portable insulated storage container.

In another example, a portable insulated storage container includes an outer layer, an inner liner, insulation, an opening, a closure mechanism, and a strap. The inner liner is positioned inside the outer shell and defines a storage volume inside the portable insulated storage container. The optional insulation is between the inner liner and the outer shell. The opening extends through the outer shell and the inner liner for accessing the storage volume from outside the portable insulated storage container. The closure mechanism selectively provides access to the storage volume through the opening when the closure mechanism is an opened position and closes the opening when the closure mechanism in a closed position. The strap is attached to the insulated storage container and has a first backpack strap portion, a second backpack strap portion, and a shoulder strap portion. The strap is configured to be removably clamped by the closure mechanism in a first clamp location and in a second clamp location when the closure mechanism is in the closed position. The first and second clamp locations define lengths of the first backpack strap portion, the second backpack strap portion, and the shoulder strap portion. The lengths of the first backpack strap portion, the second backpack strap portion, and the shoulder strap portion are adjustable when the closure mechanism is in the opened position and fixed when the closure mechanism is in the closed position.

In another example, an insulated storage container includes an outer shell, an inner liner, a closure mechanism, and insulation. The inner liner is positioned inside the outer shell and defines a storage volume inside the insulated storage container. The closure mechanism is attached to the inner liner and the outer shell. The closure mechanism includes a first rigid member hingedly attached to a second rigid member for selectively providing access to the storage volume when the closure mechanism is in an opened position. The closure mechanism defines a closable opening extending through the outer shell and the inner liner for accessing the storage volume from outside the portable insulated storage container when the closure mechanism is in the opened position and for closing the opening when the closure mechanism in a closed position. Insulation is positioned between the inner liner and the outer shell. The insulated storage container may also include a gasket configured to seal between the first rigid member and the second rigid member of the closure mechanism to seal the opening when the closure mechanism is in the closed position.

In yet another example, a storage container includes an insulated shell that defines a storage volume inside an insulated storage container for storing one or more items. The insulated shell has a bottom, a plurality of sides, and a rectangular opening defined by tops of the plurality of sides of the insulated shell. The storage container also includes a closure mechanism attached to the rectangular opening of the insulated shell at the tops of the sides of the insulated shell and extending around a perimeter of the rectangular opening. The closure mechanism has a first portion and a second portion that is hingedly attached to the first portion such that each of the first and the second portions of the closure mechanism rotate to transition the closure mechanism from an opened position to a closed position. Surfaces of the first portion and the second portion of the closure mechanism meet to close the opening of the insulated shell when in the closed position. The surfaces may include one or more gaskets and/or gasket seats for sealing the opening. The storage container may also include a clasping feature for temporarily retaining the closure mechanism in the closed position. The clasping feature may include one or more of a snap, a clip, a clasp, a hook and loop fastener, a latch, a magnet, a zipper, a lever, an arm, a cam-over mechanism, and/or an interference fit mechanism.

In yet another example, an insulated storage container includes an outer shell, an inner liner, insulation, a closure mechanism, and a strap. The inner liner is positioned inside the outer shell and defines a storage volume inside the insulated storage container. An opening extending through the outer shell and the inner liner provides access to the storage volume from outside the insulated storage container. The insulation is positioned between the inner liner and the outer shell. The closure mechanism provides selective access to the storage volume through the opening when the closure mechanism is an opened position and prevents or closes access to the storage volume when the closure mechanism in a closed position. The strap is attached to the insulated storage container and has a first backpack strap portion, a second backpack strap portion, and a shoulder strap portion. The strap is configured to be removably clamped by the closure mechanism at first and second clamp locations when the closure mechanism is in the closed position. The first and second clamp locations define lengths of the first backpack strap portion, the second backpack strap portion, and the shoulder strap portion. The lengths of the first backpack strap portion, the second backpack strap portion, and the shoulder strap portion are adjustable when the closure mechanism is in the opened position and fixed when the closure mechanism is in the closed position.

In a further example, an insulated storage container includes an insulated body, a closure mechanism, and a clasping feature. The insulated body defines a storage volume inside the insulated storage container for storing one or more items. The insulated body has a bottom, a plurality of sides, and a rectangular opening defined by top edges of the plurality of sides of the insulated body. The closure mechanism is attached to the rectangular opening of the insulated body at the top edges of the sides of the insulated body and extends around a perimeter of the rectangular opening. The closure mechanism has a first portion and a second portion that is hingedly attached to the first portion such that each of the first and the second portions of the closure mechanism pivot about an axis to transition the closure mechanism between an opened position and a closed position. Surfaces of the first portion and the second portion of the closure mechanism contact to close the opening of the insulated body when in the closed position. The clasping feature temporarily retains the closure mechanism in the closed position.

FIG. 12 illustrates a front view of a portable cooler 200. Portable cooler 200 includes a body portion 210 and a top portion 220. Each of body portion 210 and top portion 220 may be made from one or more components including materials such as textiles, fabrics, canvas, nylon, ballistic nylon, Kevlar, plastics, and/or rubber. Top portion 220 includes a lid which provides access to an inner storage volume 222 of portable cooler 200. The lid may be attached to a lip or upper frame portion 220 with one or more hinge elements and may have one or more clasping elements to maintain the lid in a closed position when the contents or storage volume of portable cooler 200 are not being accessed.

One or more types of insulation may be included between an inner liner 214 and body 210. Insulation may also be included in the lid. The insulation may be attached to any of inner liner 214, body portion 210, and/or top portion 220. Top portion 220 may also include a latching mechanism 224 for opening and/or closing portable cooler 200. Portable cooler 200 may have two or more separate internal compartments for storing different types of items and/or for keeping ice or water separate from other items.

In some configurations, portable cooler 200 may include a strap 230 for carrying portable cooler 200. Strap 230 is an example of strap 130. In some configurations, strap 230 may be adjustable in length and/or may be removable. Portable cooler 200 may also include one or more attachment points 270. Attachment point 270 is an example of attachment point 170. Portable cooler 200 may also include a pocket, similar to pocket 181 and/or pocket 182.

Figure 13:
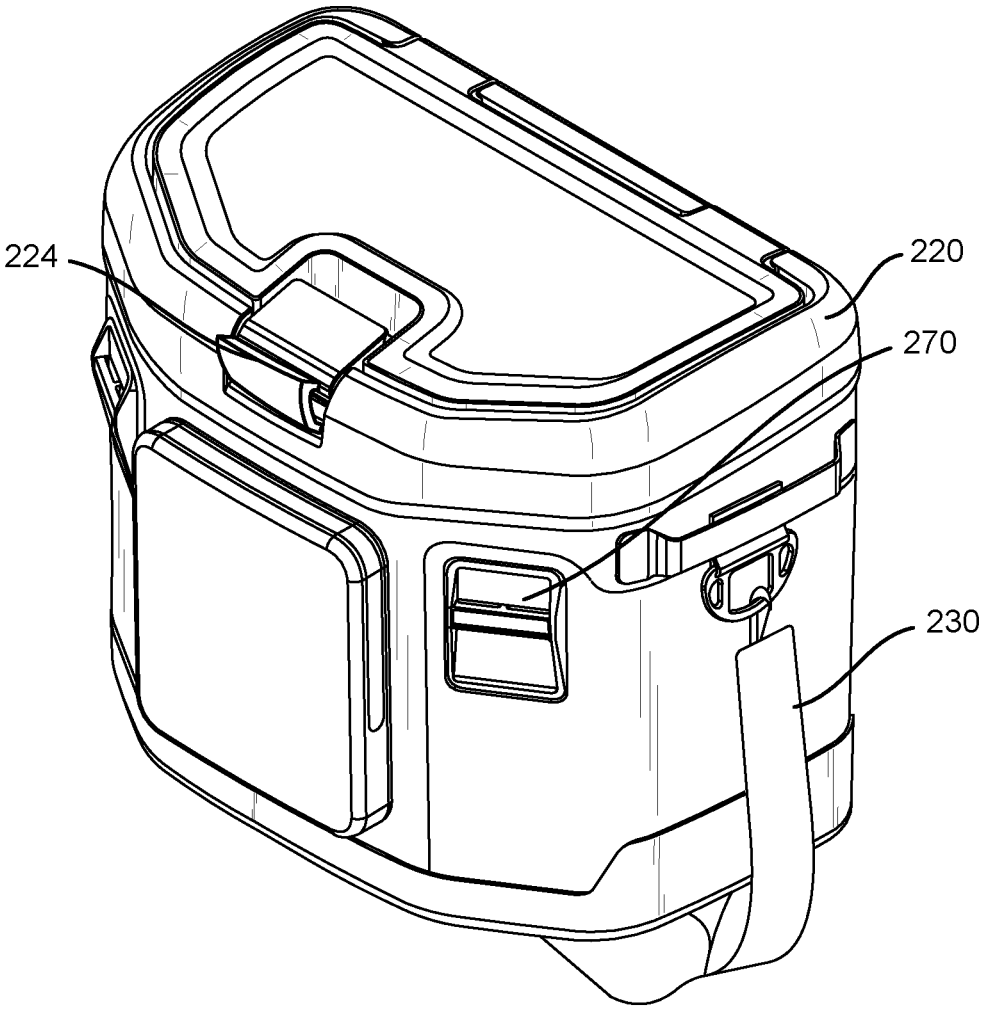
FIG. 13 illustrates a front perspective view of the portable cooler of FIG. 12.
Figure 15:
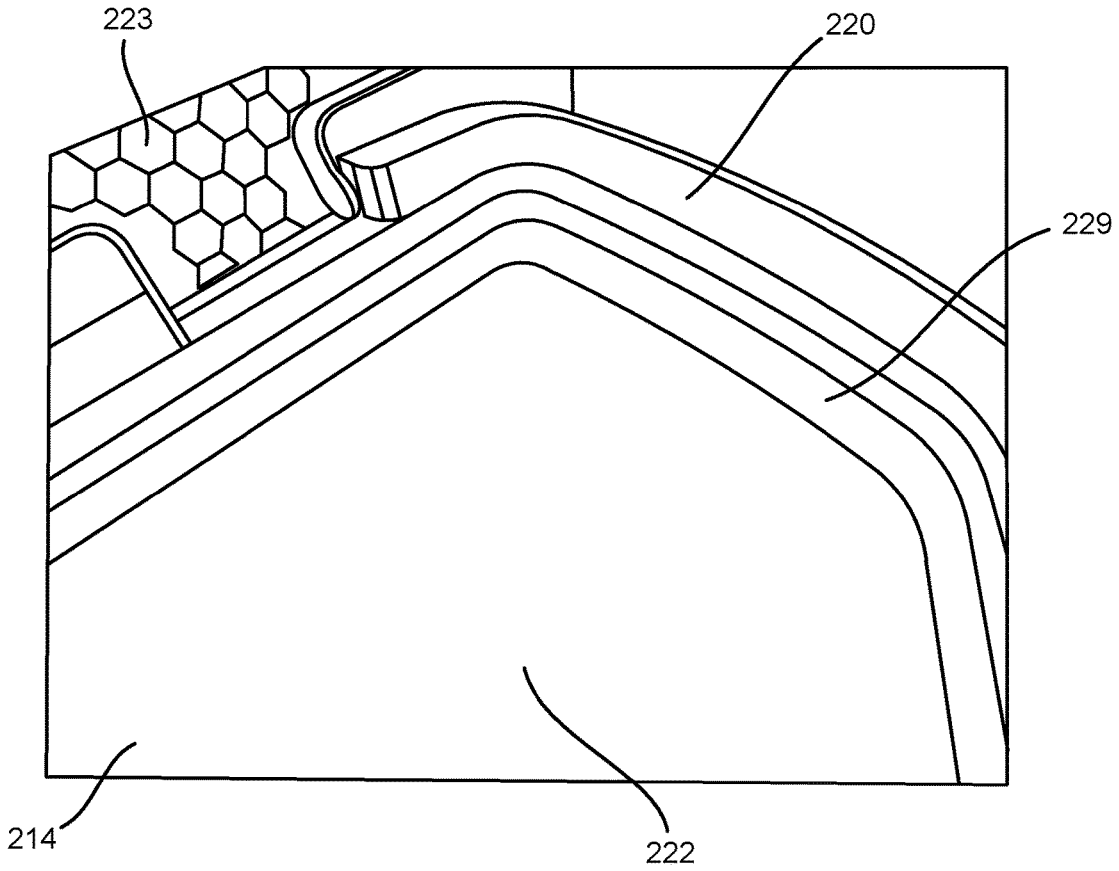
FIG. 15 illustrates a close up view of a portion of the portable cooler of FIG. 12 with the lid opened.

FIG. 13 illustrates a front perspective view of portable cooler 200. FIG. 13 illustrates a bottle opener 172 removably attached to attachment point 270 on an outside surface of cooler 200. FIG. 14 illustrates portable cooler 200 with the lid of top portion 220 opened for accessing the internal storage volume of portable cooler 200. FIG. 15 illustrates a close up view of a portion of cooler 200 with the lid opened. FIG. 15 includes gasket 229 for sealing cooler 200 when lid 223 (partially visible) is in the closed position. The seal may be waterproof or water resistant to prevent, for example, leakage of water or other liquids from inside cooler 200 if cooler 200 is laying on its side and/or inverted. In the example of FIG. 15, gasket 229 and/or inner liner 214 may be captured and held in place between top portion 220 and body 210 when cooler portable cooler 200 is assembled. In some cases liner 214 may be removable and/or replaceable. Lid 223 of top portion 220 contacts gasket 229 when lid 223 is in a closed position. Gasket 229 may form a seal when compressed between lid 223 and top portion 220 and/or inner liner 214 when latch 224 is used to latch the lid in the closed position. Other gasket configurations are possible including multiple gaskets, a removable gasket, and/or a formed-in-place gasket.

Figure 16A:
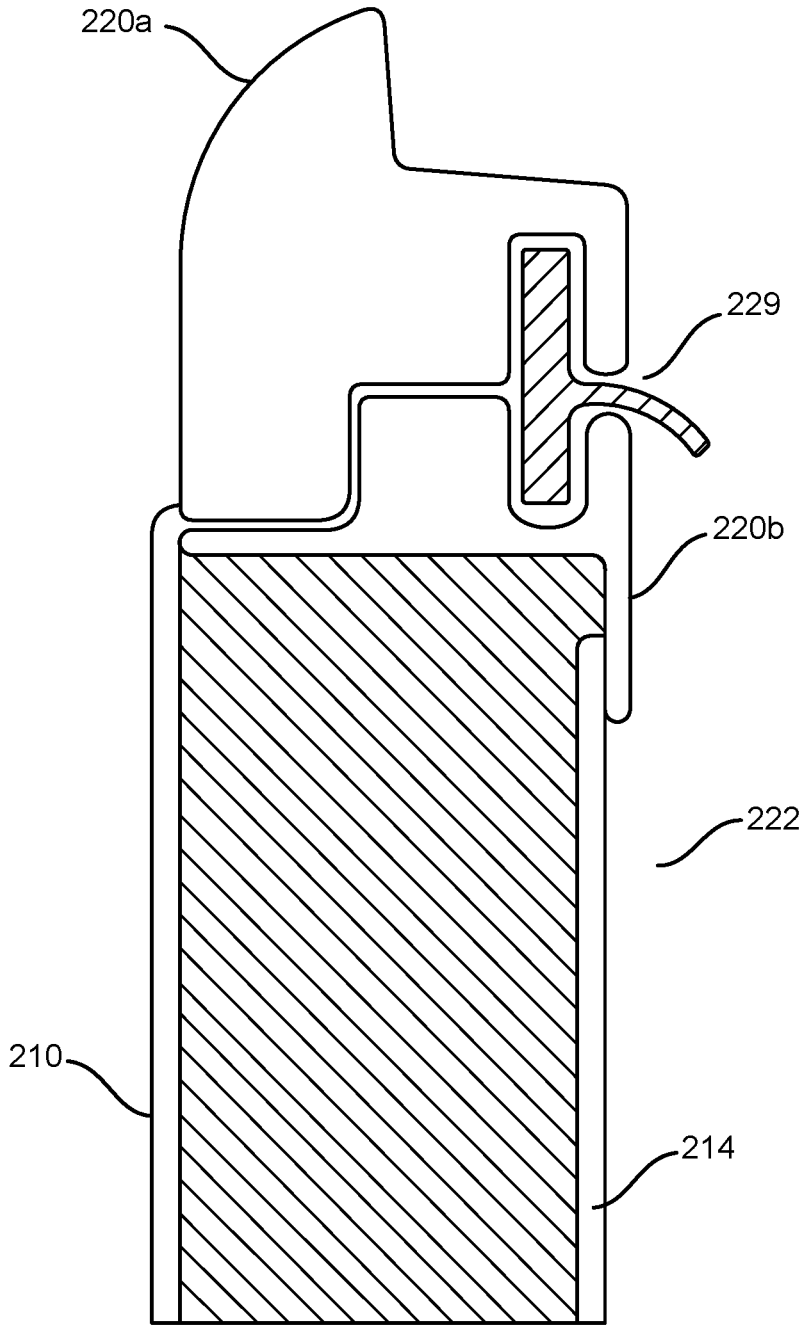
FIG. 16A illustrates a cross section of a wall of the portable cooler of FIG. 12.

FIG. 16A illustrates a cross section of a wall of portable cooler 200. FIG. 16A illustrates that top portion 220 may comprise two or more portions, such as first top portion 220*a* and second top portion 220*b*, which attach to each other to retain gasket 229. Gasket 229 extends around the internal perimeter opening of portable cooler 200 for sealing the opening. Lid 223 (not illustrated in FIG. 16A) seals against gasket 229 when in the closed position. First top portion 220*a* and second top portion 220*b* may be attached to each other using any one or more of: a snap connection, tabs, an interference fit, electro-welding, thermoplastic welding, co-molding, melting, adhesive, gluing, and/or one or more fasteners.

Liner 214 may be directly attached to second top portion 220*b* to form a water resistant or waterproof seal. Beneficially, this configuration eliminates a leak path where liner 214 is attached to second top portion 220*b*, but without requiring an additional gasket, component, or sealing mechanism. Liner 214 may be attached to second top portion 220*b* using any one or more of electro-welding, thermoplastic welding, co-molding, clamping, compression, melting, heat rolling, hot-melting, and/or fasteners. As illustrated in FIG. 16A, an outer layer of body 210 may also be attached directly to one or both portions of top portion 220. This interface may also be water-resistant or waterproof. Liner 214 may be attached to one or both portions of top portion 220 using any one or more of electro-welding, thermoplastic welding, co-molding, clamping, compression, melting, heat rolling, hot-melting, and/or fasteners. One or more types or layers of insulation may be placed between liner 214 and the outer layer of body 210.

Figure 16B:
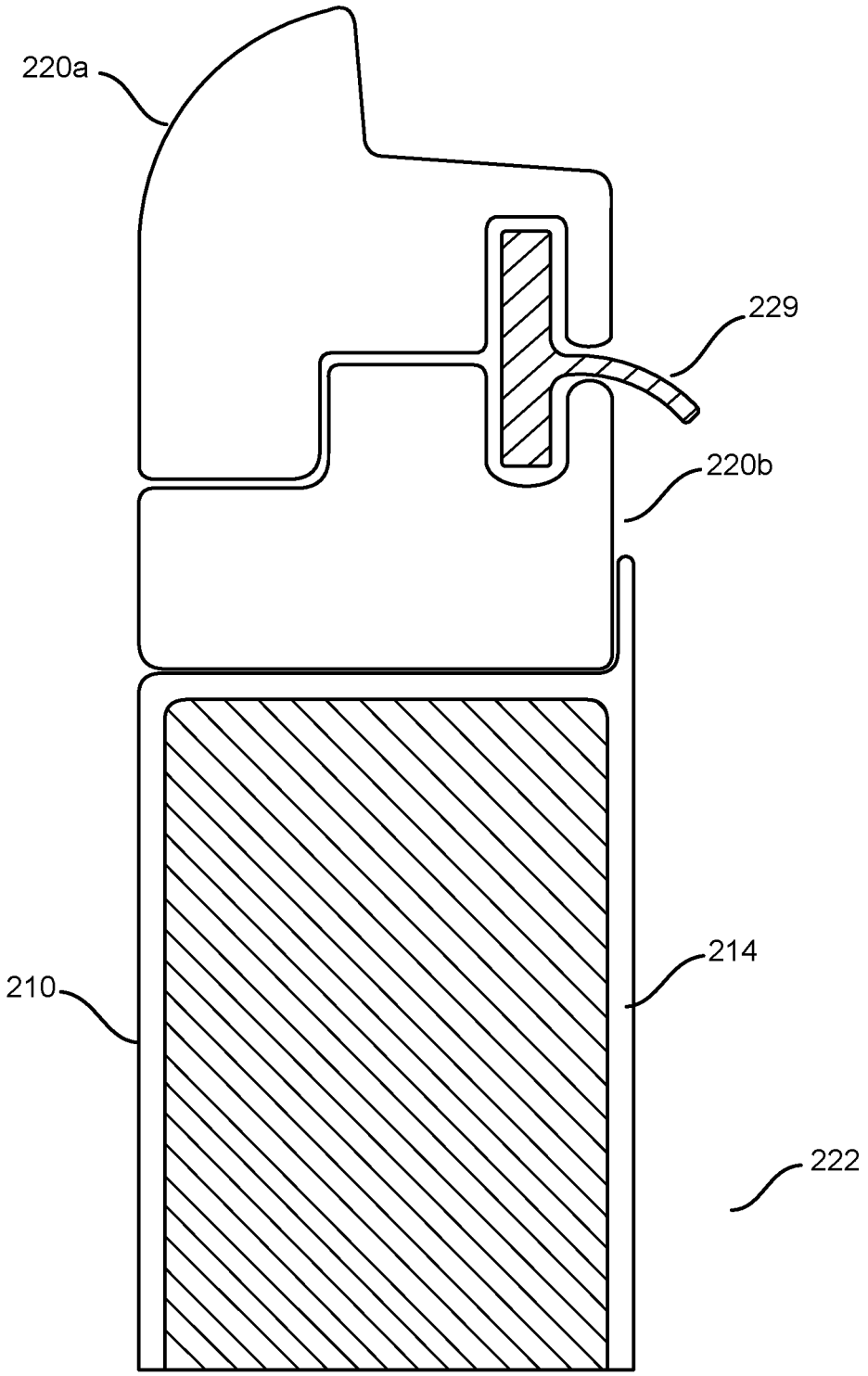
FIG. 16B illustrates a cross section of a wall of an alternate embodiment of the cooler of FIG. 12.

FIG. 16B illustrates a variation of the embodiment illustrated in FIG. 16A. In the embodiment of FIG. 16B, the out layer of body 210 is attached to the same inner surface of second top portion 220*b* and/or is attached to liner 214. The attachment to one or both may be accomplished using any one or more of electro-welding, thermoplastic welding, co-molding, clamping, compression, melting, heat rolling, hot-melting, and/or fasteners. In some cases, liner 214 and the outer layer of body 210 may be formed as a single piece of material that is attached to second top portion 220*b* and/or first top portion 220*a*.

Any of the storage containers disclosed herein may contain an external device that indicates a temperature and/or a temperature range of the internal storage compartment. For example, an external wall or lid may contain a thermometer readout or a temperature sensitive patch that relays information about the internal environment.

Any of the techniques, improvements, devices, components, features, functions, and/or processes described herein may be implemented in the form of a system. The system may include any combination of the techniques, improvements, devices, components, features, functions, and/or processes disclosed herein.

The techniques, improvements, devices, components, features, functions, and/or processes described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "in other examples," "in some cases," "in some situations," "in one configuration, " "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure is presented for purposes of illustration and description. Other modifications and variations may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention except as limited by the prior art.

What is claimed is:

1. A portable insulated storage container comprising:

an outer layer;

an inner liner positioned inside the outer layer, the inner liner bounding an internal storage volume inside the portable insulated storage container;

insulation positioned between the inner liner and the outer layer for thermally insulating the internal storage volume;

a closable opening extending through the outer layer and the inner liner for accessing the internal storage volume from outside the portable insulated storage container; and a closure mechanism having a first rigid member hingedly attached to a second rigid member, the closure mechanism configured for permitting access to the internal storage volume through the closable opening when the closure mechanism is an opened position and configured for closing the closable opening when the closure mechanism in a closed position, wherein the closure mechanism extends around a perimeter of the closable opening, wherein the first rigid member and the second rigid member each extend around respective portions of the perimeter of the closable opening, wherein the first rigid member and the second rigid member are configured to pivot in opposite directions to transition the closure mechanism from the closed position to the opened position and are in substantially a same plane when the closure mechanism is in the opened position, and wherein the closure mechanism is configured to maintain the opened position without continuous application of an external force.

2. The portable insulated storage container of claim 1 wherein the closure mechanism is configured to require application of an external closing force to initiate a transition from the opened position toward the closed position.

3. The portable insulated storage container of claim 1 wherein the outer layer includes two opposed upper side portions attached to respective portions of each of the first rigid member and the second rigid member of the closure mechanism, wherein each upper side portion of the outer layer forms an inwardly cupped pocket when the closure mechanism is in the closed position, each inwardly cupped pocket being adjacent to the respective portions of each of the first member and the second member when the closure mechanism is in the closed position.

4. The portable insulated storage container of claim 3 wherein the insulation does not extend into areas where the inwardly cupped pockets are formed.

5. The portable insulated storage container of claim 3 wherein a stiffness of the outer layer that is overcome to form the inwardly cupped pockets provides an inherent springing force tending to release the inwardly cupped pockets thereby assisting with transition of the closure mechanism from the closed position to the opened position.

6. A portable insulated storage container comprising:

an outer shell comprising a flexible material;

an inner liner positioned inside the outer shell, the inner liner defining an internal storage volume inside the portable insulated storage container;

insulation layered between the inner liner and the outer shell for thermally insulating the internal storage volume;

an opening extending through the outer shell and the inner liner for accessing the internal storage volume from outside the portable insulated storage container; and a closure mechanism having a first rigid member hingedly attached to a second rigid member with two living hinges, the closure mechanism attached to the outer shell and the inner liner and configured to provide access to the internal storage volume through the opening when the closure mechanism is an opened position, the closure mechanism further configured for closing the opening when the closure mechanism in a closed position, wherein the first rigid member and the second rigid member each extend around respective portions of a perimeter of the opening, wherein the first rigid member and the second rigid member are each configured to hingedly pivot approximately 90 degrees away from the closed position in opposite directions to reach the opened position, wherein the first rigid member is oriented approximately 180 degrees with respect to the second rigid member when the closure mechanism is in the opened position.

7. The portable insulated storage container of claim 6 wherein the closure mechanism includes one or more gaskets configured for forming a watertight seal when the closure mechanism is in the closed position.

8. The portable insulated storage container of claim 6 further comprising a bottom cover extending over a bottom portion of the outer shell to form a substantially flat base area configured for standing the portable insulated storage container in an upright position on a substantially horizontal surface.

9. The portable insulated storage container of claim 8 wherein the opening is substantially rectangular and comprises an area that is larger than an area of the substantially flat base area when the closure mechanism is in the opened position.

10. The portable insulated storage container of claim 6 further comprising a strap, wherein the strap includes a first backpack strap portion, a second backpack strap portion, and a shoulder strap portion.

11. The portable insulated storage container of claim 10 wherein the strap is configured to be removably clamped by a latch of the closure mechanism at first and second clamp locations on the strap when the closure mechanism is in the closed position, the first and second clamp locations defining lengths of each of the first backpack strap portion, the second backpack strap portion, and the shoulder strap portion, wherein the lengths of the first backpack strap portion, the second backpack strap portion, and the shoulder strap portion are adjustable when the closure mechanism is in the opened position and fixed when the closure mechanism is in the closed position.

12. The portable insulated storage container of claim 6 wherein the two living hinges are formed from plastic.

13. An insulated storage container comprising:

an outer shell;

an inner shell positioned inside the outer shell, the inner shell defining an internal storage volume inside the portable insulated storage container;

insulation positioned between the inner shell and the outer shell for thermally insulating the internal storage volume;

an opening extending through the outer shell and the inner shell for accessing the internal storage volume of the insulated storage container from outside the insulated storage container; and a closure mechanism having two frame members, two hinges, and a gasket, each of the two frame members attached to the other frame member by the two hinges, the closure mechanism configured for providing access to the internal storage volume through the opening when the closure mechanism is an opened position, the two frame members of the closure mechanism configured to pivot open about the two hinges to form a substantially planar rectangular perimeter of the opening when the closure mechanism is in the opened position, the two frame members of the closure mechanism further configured to pivot toward each other about the two hinges to transition the closure mechanism from the opened position to a closed position, wherein the gasket is compressed between the two frame members in the closed position.

14. The insulated storage container of claim 13 wherein the outer shell includes two opposed upper side portions, each upper side portion attached to a respective portion of the closure mechanism, wherein each upper side portion of the outer shell flexes to form an inwardly cupped pocket when the closure mechanism is in the closed position, each inwardly cupped pocket adjacent to a respective one of the hinges.

15. The insulated storage container of claim 14 wherein the insulation does not extend to areas where the inwardly cupped pockets are formed.

16. The insulated storage container of claim 14 wherein forming the inwardly cupped pockets overcomes a stiffness of the outer layer resulting in an inherent springing force tending to assist with transition of the closure mechanism from the closed position to the opened position.

17. The insulated storage container of claim 13 further comprising an abrasion resistant base cover extending over a bottom portion of the outer shell.

18. The insulated storage container of claim 17 wherein the base cover includes a substantially flat bottom configured for standing the insulated storage container in an upright position on a substantially horizontal surface.

19. The insulated storage container of claim 18 wherein the opening comprises an area that is larger than an area of the substantially flat bottom.

20. The insulated storage container of claim 13 further comprising a strap, wherein the strap includes a first backpack strap portion, a second backpack strap portion, and a shoulder strap portion, wherein lengths of each of the first backpack strap portion, the second backpack strap portion, and the shoulder strap portion are adjustable when the closure mechanism is in the opened position and temporarily fixed when the closure mechanism is in the closed position.

* * * * *